US009392881B1

(12) United States Patent
Schmelzle

(10) Patent No.: US 9,392,881 B1
(45) Date of Patent: Jul. 19, 2016

(54) BABY COMFORT SYSTEMS

(76) Inventor: James Joseph Schmelzle, Flagstaff, AZ (US)

( * ) Notice: Subject to any disclaimer, the term of this patent is extended or adjusted under 35 U.S.C. 154(b) by 995 days.

(21) Appl. No.: 13/419,724

(22) Filed: Mar. 14, 2012

Related U.S. Application Data

(60) Provisional application No. 61/452,421, filed on Mar. 14, 2011, provisional application No. 61/492,746, filed on Jun. 2, 2011.

(51) Int. Cl.
*A47D 9/02* (2006.01)
*A47D 9/00* (2006.01)

(52) U.S. Cl.
CPC ... *A47D 9/02* (2013.01); *A47D 9/00* (2013.01)

(58) Field of Classification Search
CPC ..... A47D 9/00; A47D 9/02; A47D 9/04; A61G 13/04; A61G 13/06; A61G 13/08; A61G 7/002; A61G 7/005; A61G 7/008; A61G 7/012; A61G 7/015; A61G 7/018; A61B 6/0407
USPC ..... 5/655, 108, 109, 600, 607–611
See application file for complete search history.

(56) References Cited

U.S. PATENT DOCUMENTS

| | | | | |
|---|---|---|---|---|
| 3,392,723 | A | 7/1968 | Calvin | |
| 4,656,680 | A | 4/1987 | Wilson | |
| 4,681,096 | A | 7/1987 | Cuervo | |
| 4,893,366 | A | 1/1990 | Rosen | |
| 4,947,832 | A * | 8/1990 | Blitzer | 601/56 |
| 4,951,331 | A | 8/1990 | Pereira | |
| 5,037,375 | A * | 8/1991 | Gatts | 600/21 |
| 5,183,457 | A * | 2/1993 | Gatts et al. | 600/21 |
| 5,711,045 | A * | 1/1998 | Caster et al. | 5/109 |
| 5,845,350 | A * | 12/1998 | Beemiller et al. | 5/109 |
| 6,142,963 | A | 11/2000 | Black et al. | |
| 7,346,949 | B2 | 3/2008 | Kamrin-Balfour | |
| 7,395,560 | B2 | 7/2008 | Bloemer et al. | |
| 7,478,446 | B2 | 1/2009 | Sims, Jr. | |
| 7,551,100 | B1 | 6/2009 | Salley et al. | |
| 7,591,035 | B2 * | 9/2009 | Guo | 5/600 |
| 7,653,952 | B2 * | 2/2010 | Guo | A47C 21/006 5/600 |
| 7,654,952 | B2 * | 2/2010 | Ott | 600/178 |
| 7,814,587 | B2 | 10/2010 | Thomas | |
| 2004/0123383 | A1 | 7/2004 | Nguyen | |
| 2007/0143923 | A1 * | 6/2007 | Guo | 5/608 |
| 2007/0143924 | A1 * | 6/2007 | Guo | 5/608 |
| 2009/0183310 | A1 * | 7/2009 | Thomas | 5/109 |
| 2010/0192304 | A1 | 8/2010 | Kovalyak | |
| 2010/0262050 | A1 | 10/2010 | Gasparovich | |

FOREIGN PATENT DOCUMENTS

| | | | |
|---|---|---|---|
| EP | 2 292 124 | A1 | 3/2011 |
| WO | 98/17150 | | 4/1998 |
| WO | 02/05687 | A2 | 1/2002 |
| WO | 2005/046399 | A1 | 5/2005 |

* cited by examiner

*Primary Examiner* — Robert G Santos
(74) *Attorney, Agent, or Firm* — Lodestar Patents, PLLC; Raymond J. E. Hall

(57) ABSTRACT

Systems and apparatus relating to providing one or more combinations of motion, vibration, and sound to comfort babies or infants, particularly babies or infants who are crying, experiencing discomfort, or having sleeping difficulties.

20 Claims, 21 Drawing Sheets

BABY COMFORT SYSTEMS

CROSS-REFERENCE TO RELATED APPLICATION

The present application is related to and claims priority from prior provisional application Ser. No. 61/492,746, filed Jun. 2, 2011, entitled "BABY COMFORT SYSTEMS"; and, this application is related to and claims priority from prior provisional application Ser. No. 61/452,421, filed Mar. 14, 2011, the contents of all of which are incorporated herein by this reference and are not admitted to be prior art with respect to the present invention by the mention in this cross-reference section.

BACKGROUND

This invention relates to providing a system for improved baby comforting. More particularly, this invention relates to providing systems and apparatus relating to providing one or more combinations of motion, vibration, and sound to comfort babies or infants, particularly babies or infants who are crying, experiencing discomfort, or having sleeping difficulties.

Babies and infants are often prone to extended periods of crying or discomfort. Crying or discomfort can be caused by a variety of factors, such as difficulty eating or sleeping, transitioning from the intrauterine environment, or other environmental or emotional issues. When the crying or discomfort is prolonged, comforting or calming the infant can become increasingly difficult and the periods of crying or discomfort can occur more readily. Parents, caretakers, and other adults and children who hear or see a baby/infant crying or experiencing discomfort can also experience emotional discomfort.

It would be useful to provide a system and apparatus to assist reduction of infant crying or discomfort, as well as assist sleeping for such baby/infants.

OBJECTS AND FEATURES OF THE INVENTION

A primary object and feature of the present invention is to provide a system overcoming the above-mentioned problem(s).

It is a further object and feature of the present invention to provide such a system providing a combination of motion, vibration, and sound to comfort infants, particularly crying babies/infants.

It is a further object and feature of the present invention to provide such a system providing a baby-comforting apparatus that may be hand-carried.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system, relating to providing a portable sleep-assisting environment to assist sleep of at least one infant in at least one infant carrier, comprising: at least one sleep-assisting apparatus housing structured and arranged to house at least one sleep-assisting apparatus; wherein such at least one sleep-assisting apparatus housing comprises at least one lower housing structured and arranged to house lower elements, and at least one upper housing structured and arranged to house upper elements, wherein such at least one upper housing comprises at least one cradle structured and arranged to cradle at least the at least one infant carrier, and wherein such at least one lower housing comprises at least one first support structured and arranged to support such at least one upper housing; wherein such at least one sleep-assisting apparatus housing further comprises at least one separator structured to arrange to separate movement between such at least one lower housing and such at least one upper housing; wherein such at least one sleep-assisting apparatus housing comprises at least one motion-generator structured and arranged to generate motion to such at least one cradle; wherein such at least one motion-generator comprises at least one controller structured and arranged to assist user-control of at least one on/off motion control; wherein such at least one motion-generator comprises at least one motion-transferer structured and arranged to transfer motion to such at least one cradle; wherein such at least one motion-transferer comprises shaft-driven rotary planar to linear planar translational motion elements structured and arranged to provide shaft-driven rotary planar to linear planar translational motion to such shaft-driven rotary planar to linear planar translational motion cradle when such shaft-driven rotary planar to linear planar translational motion upper housing is situate upon such shaft-driven rotary planar to linear planar translational motion lower housing; and wherein such at least one sleep-assisting apparatus housing comprises at least one hand-carryable element structured and arranged to assist hand-carrying of such at least one sleep-assisting apparatus housing.

Moreover, it provides such a system wherein such at least one upper housing and such at least one lower housing together comprise at least one box geometry comprising at least two half-box sections structured and arranged to be removably coupled into such at least one box geometry. Additionally, it provides such a system wherein such at least one separator comprises such at least two half-box sections. Also, it provides such a system wherein such at least one motion-generator comprises at least one motor, having at least one motor crankshaft, capable of generating at least rotational motion. In addition, it provides such a system wherein such at least one motion-transferer comprises: at least one lever, attachable to such at least one motor crankshaft and structured and arranged to transfer such rotational motion; and at least one receiver attached to such at least one upper housing structured and arranged to receive such rotational motion from such at least one lever and transfer such rotational motion to such at least one cradle portion.

And, it provides such a system wherein: such at least one lever comprises at least one projecting engager structured and arranged to assist rotational transfer of such rotational motion; and such at least one receiver is structured and arranged to receive such at least one projecting engager. Further, it provides such a system wherein such at least one lever comprises exactly one lever having a length from about one inch to about two inches. Even further, it provides such a system wherein such at least one projecting engager comprises exactly one projecting engager having a diameter from about one-eighth inch to about two inches. Moreover, it provides such a system wherein such at least one controller comprises at least one on/off motor-power-supply switch. Additionally, it provides such a system wherein such at least one motor comprises at least one motor sounder structured and arranged to cause sound vibration sufficient to vibrate such at least one cradle portion.

Also, it provides such a system wherein such at least one lower housing is structured and arranged to enhance sound-vibration from such at least one motor sounder. In addition, it provides such a system wherein such at least one motor comprises at least one motor vibrator structured and arranged to cause vibration sufficient to vibrate such at least one cradle portion. And, it provides such a system wherein such at least one sleep-assisting apparatus housing comprises at least one vibrator structured and arranged to cause vibration sufficient to vibrate at least such at least one cradle portion. Further, it provides such a system wherein such at least one upper housing comprises: a first side; and a second side; wherein such first side comprises such at least one cradle; and wherein such second side comprises such at least one receiver. Even further, it provides such a system wherein such at least one lower housing comprises: a third side; and a fourth side; wherein such third side comprises such at least one first support to support such at least one upper housing; and wherein such fourth side comprises at least one second support to support such lower housing. Even further, it provides such a system wherein such at least one sleep-assisting apparatus housing comprises at least one lockable coupler structured and arranged to provide lockable coupling to couple together such at least one lower housing and such at least one upper housing.

Even further, it provides such a system wherein such at least one hand-carryable element comprises at least one handle structured and arranged to assist hand-carrying by at least one person. Even further, it provides such a system wherein such at least one cradle is structured and arranged to cradle at least one baby carrier.

In accordance with another preferred embodiment hereof, this invention provides a system, relating to providing a portable sleep-assisting environment to assist sleep of at least one infant in at least one infant carrier, comprising: sleep-assisting apparatus housing means for housing at least one sleep-assisting apparatus; wherein such sleep-assisting apparatus housing means comprises lower housing means for housing lower elements, and upper housing means for housing upper elements, wherein such upper housing means comprises cradle means for cradling at least the at least one infant carrier, and wherein such lower housing means comprises support means for supporting such upper housing means; wherein such sleep-assisting apparatus housing means further comprises separator means for separating movement between such lower housing means and such upper housing means; wherein such sleep-assisting apparatus housing means comprises motion-generator means for generating motion to such cradle means; wherein such motion-generator means comprises controller means for assisting user-control of at least one on/off motion control; wherein such motion-generator means comprises motion-transferer means for transferring motion to such cradle means; wherein such motion-transferer means comprises means for providing shaft-driven rotary planar to linear planar translational motion to such cradle means when such upper housing means is situate upon such lower housing means; and wherein such sleep-assisting apparatus housing means comprises hand-carryable element means for assist hand-carrying of such sleep-assisting apparatus housing means. Even further, it provides such a system wherein such sleep-assisting apparatus housing means comprises lock means for locking such upper housing means and such lower housing means together.

In accordance with another preferred embodiment hereof, this invention provides a system comprising each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
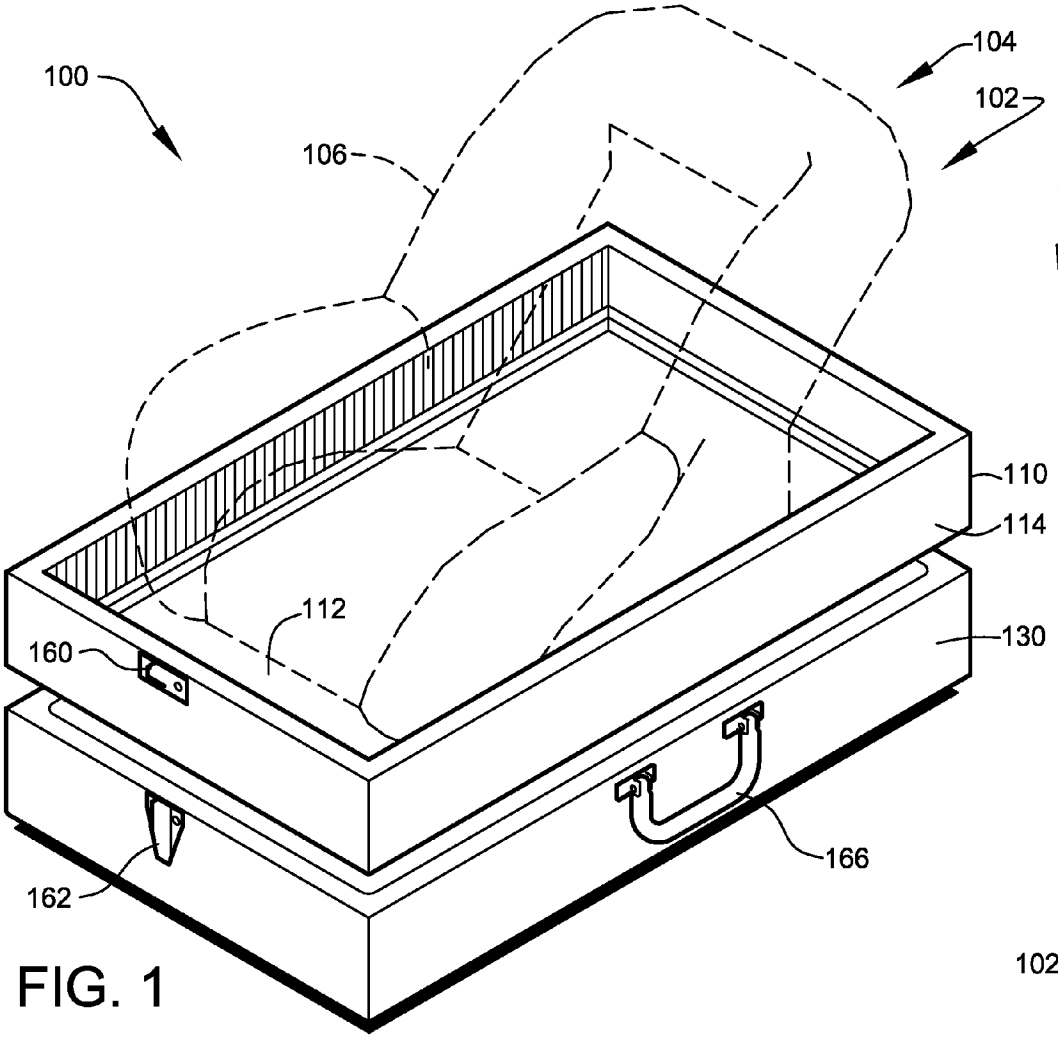
FIG. 1 shows a perspective view, illustrating an operable position of an apparatus of a baby comfort systems, according to a preferred embodiment of the present invention.

FIG. 1 shows a perspective view, illustrating at least one operable position 104 of an apparatus 102 of baby comfort systems 100, according to a preferred embodiment of the present invention. Apparatus 102 preferably comprises at least one upper housing portion 110, preferably exactly one upper housing portion 110 and at least one (lower) base housing portion 130, preferably exactly one base housing portion 130. Upper housing portion 110 preferably is capable of removably resting on base housing portion 130 while in operable position 104, as shown. When separated and arranged in the depicted operable position of FIG. 1, upper housing portion 110 preferably is movable relative to base housing portion 130 (see further details below). The above arrangement at least embodies herein wherein said at least one sleep-assisting apparatus housing further comprises at least one separator structured to arrange to separate movement between said at least one lower housing and such at least one upper housing; and, this arrangement at least embodies herein wherein such sleep-assisting apparatus housing means further comprises separator means for separating movement between such lower housing means and such upper housing means. Further, this arrangement at least embodies herein wherein such at least one separator comprises such at least two half-box sections.

Apparatus 102 of baby comfort systems 100 preferably comprises a sleep assisting apparatus meaning herein to include one or more combinations of motion, vibration, and sound to calm, comfort babies or infants, particularly babies or infants who are crying, experiencing discomfort, or having sleeping difficulties.

Upper housing portion 110 (at least embodying herein upper housing means for housing upper elements; and, at least embodying herein at least one upper housing structured and arranged to house upper elements) preferably comprises at least one bottom 112 onto which preferably at least one infant/baby carrier 106 preferably may be placed. Upon reading this specification, those with ordinary skill in the art will now appreciate that, under appropriate circumstances, considering such issues as design preference, user preferences, marketing preferences, cost, structural requirements, available materials, technological advances, etc., other items such as, for example, a baby/infant carrier blanket, a mattress, other infant supports, etc., may suffice.

Upper housing portion 110 further preferably comprises at least one cradle portion 107 (see FIG. 6) (at least embodying herein wherein such upper housing means comprises cradle means for cradling at least the at least one infant carrier; and, at least embodying herein wherein such at least one upper housing comprises at least one cradle structured and arranged to cradle at least the at least one infant carrier). Cradle portion 107 preferably comprises a box-like structure preferably comprising sidewalls 114, as shown. Sidewalls 114 preferably assist with retaining such baby carrier 106 within the inner perimeter of sidewalls 114 and bottom 112 of upper housing portion 110, as shown. The geometry and dimensions of upper housing portion 110 preferably can be selected to retain babies, infants, or infant carriers 106 of varying sizes. For example, the geometry of upper housing portion 110 can be round, square, elliptical or of other suitable shape to perform the functions taught herein. For example, the dimensions of upper housing portion 110 can be selected as larger or smaller depending on the size of the baby carrier 106, or alternately an infant, to be comforted. Preferred dimensions are described and shown herein as a box-like structure, as shown.

Apparatus 102 (at least embodying herein sleep-assisting apparatus housing means for housing at least one sleep-assisting apparatus; and at least embodying herein at least one sleep-assisting apparatus housing structured and arranged to house at least one sleep-assisting apparatus), may be fabricated from a variety of materials, for example, apparatus 102 may be fabricated from materials such as wood, metal, or other suitable synthetic materials. Apparatus 102 preferably is made from wood, preferably sealed so as to provide cleanable surfaces. Alternately preferably, a synthetic material such as plastic or other polymer may be selected. Preferably, a synthetic material comprising a dishwasher-safe material is selected. Upon reading this specification, those with ordinary skill in the art will now appreciate that, under appropriate circumstances, considering such issues as design preference, user preferences, marketing preferences, cost, structural requirements, available materials, technological advances, etc., other material arrangements such as, for example, plastics, carbon-fiber, painted surfaces, etc., may suffice.

Figure 2A:
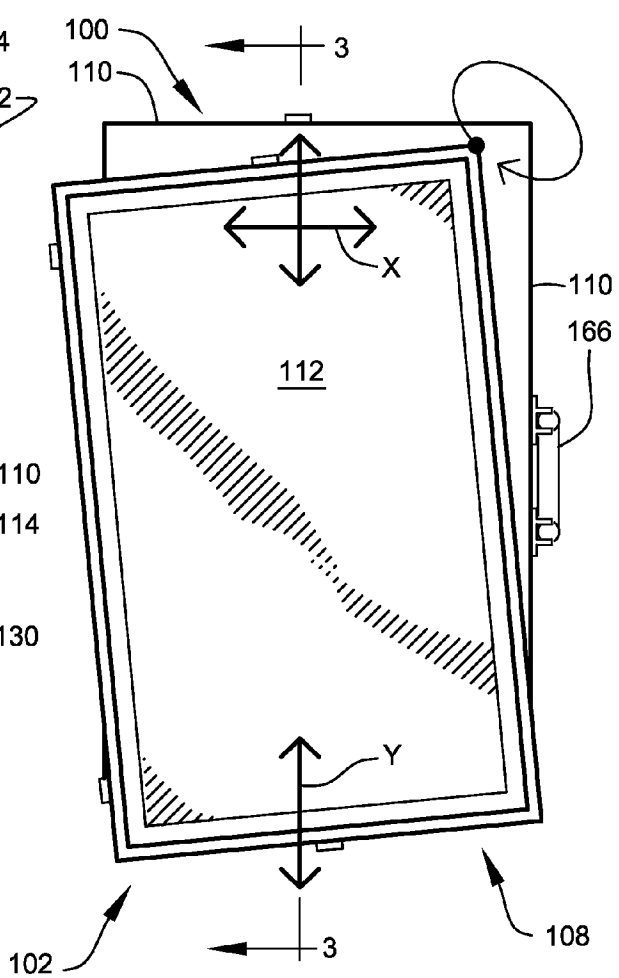
FIG. 2A shows a top view, illustrating an operable motion of an upper housing portion of the apparatus of the baby comfort systems, according to the preferred embodiment of FIG. 1.
Figure 2B:
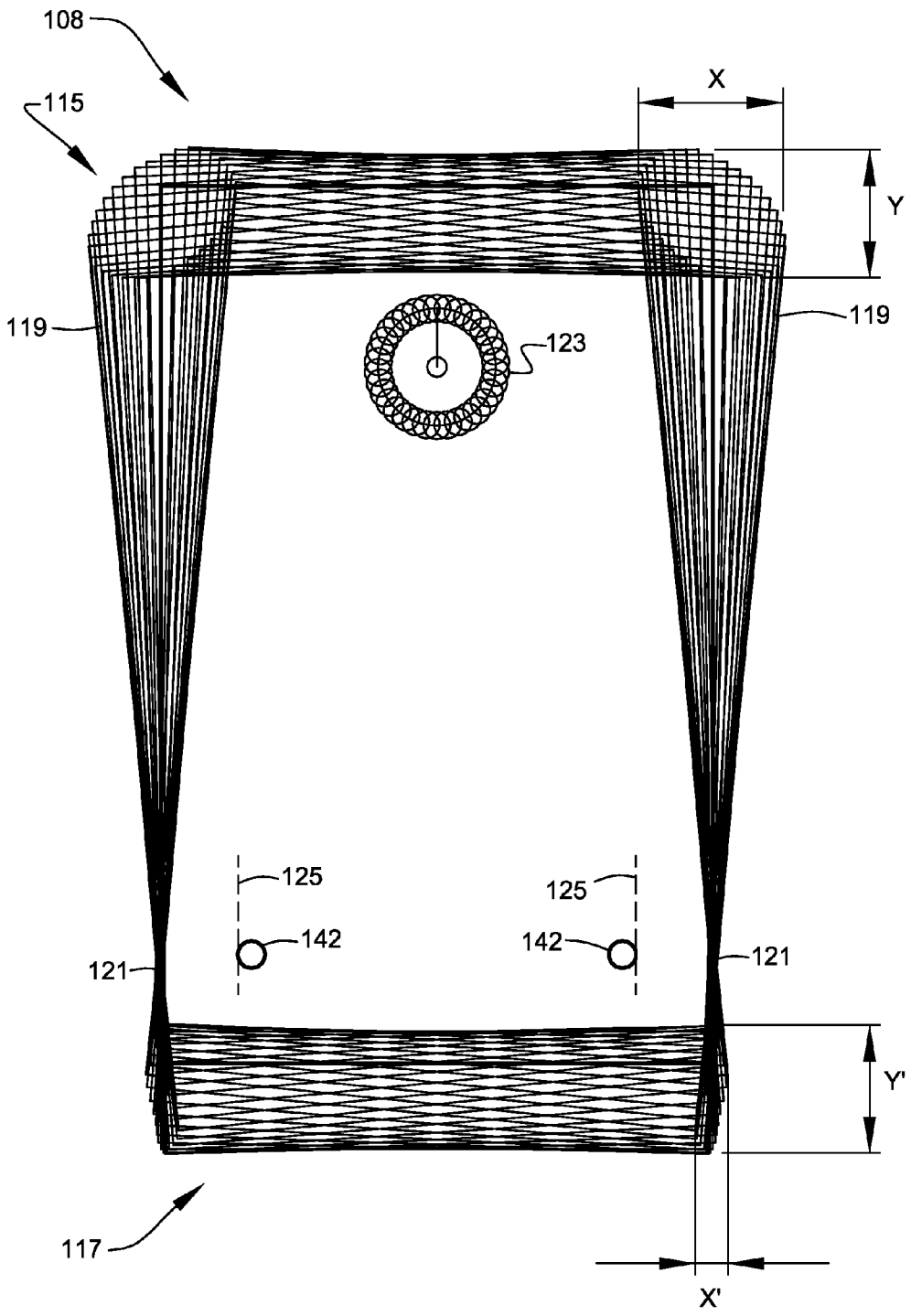
FIG. 2B shows a diagrammatic view, illustrating the operable motion of the upper housing portion, according to the preferred embodiment of FIG. 2A.

FIG. 2A shows a top view, illustrating operable motion 108 of upper housing portion 110 of apparatus 102 of baby comfort system 100, according to the preferred embodiment of FIG. 1. FIG. 2B shows a diagrammatic view, illustrating operable motion 108 of the upper housing portion 110, according to the preferred embodiment of FIG. 2A.

For purposes of teachings herein, upper housing portion 110 preferably comprises at least one vertical axis Y and at least one horizontal axis X, as shown. Operable motion 108 preferably defines herein at least the motion of upper housing portion 110 relative to a stationary position of base housing portion 130. Operable motion 108 preferably comprises an about elliptical motion 119 rotating widest along vertical axis Y and horizontal axis X at first end 115, as shown. Operable motion 108 preferably moves toward an almost linear motion 121 along vertical axis Y' and horizontal axis X' at second end 117, as shown. The above-described arrangement preferably occurs as a result of the specific structure of the upper housing portion 110 and base housing portion 130, wherein upper housing portion 110 preferably is removably resting on base housing portion 130 while in such operable motion 108. Further, such operable motion 108 arrangements as described below herein is preferred to accomplish the above-described motion. Even further, the above-described arrangement at least embodies herein wherein such motion-transferer means comprises means for providing shaft-driven rotary planar to linear planar translational motion to such cradle means when such upper housing means is situate upon such lower housing means; and, at least embodies herein wherein such at least one motion-transferer comprises shaft-driven rotary planar to linear planar translational motion elements structured and arranged to provide shaft-driven rotary planar to linear planar translational motion to such shaft-driven rotary planar to linear planar translational motion cradle when such shaft-driven rotary planar to linear planar translational motion upper housing is situate upon such shaft-driven rotary planar to linear planar translational motion lower housing.

Further, a preferred circular motion 123 of projecting engager 152 (see FIG. 4B) is depicted on FIG. 2B. The preferred center-point of circular motion 123 preferably coincides with the rotational axis of shaft 146 (see FIG. 3), as shown. In addition, the dashed line depictions 125 indicate a preferred restraint(s) of blocking 120 (see FIG. 3) along support members 142, as shown.

Figure 3:
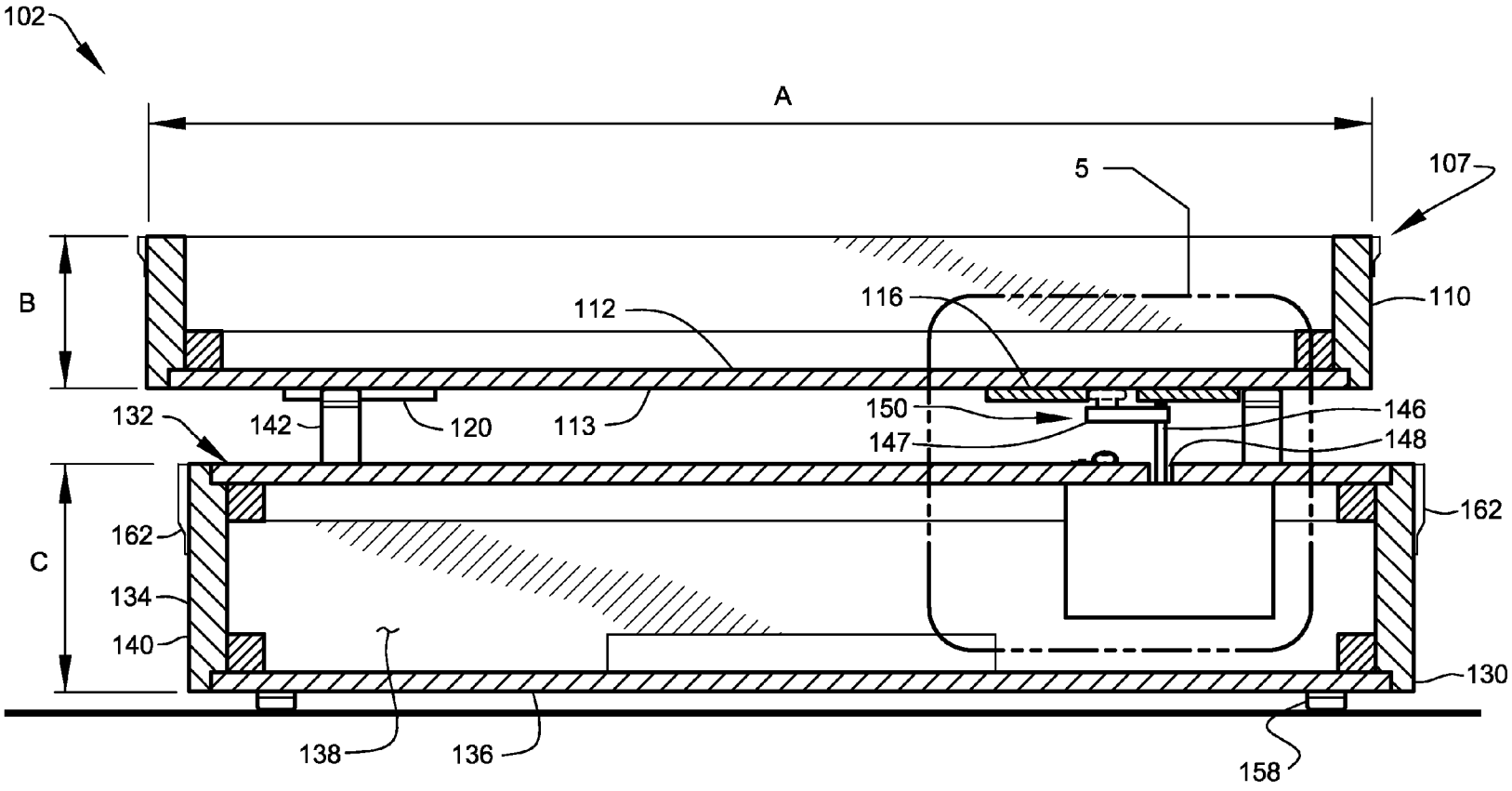
FIG. 3 shows a cross-sectional side view through Section 3-3 of FIG. 2, according to the preferred embodiment of FIG. 2A.

FIG. 3 shows a cross-sectional side view through Section 3-3 of FIG. 2, according to the preferred embodiment of FIG. 2A. Base housing portion 130 (at least embodying herein lower housing means for housing lower elements; and, at least embodying herein at least one lower housing structured and arranged to house lower elements) further preferably comprises a box-like structure comprising top 132, sides 134, bottom 136, interior cavity 138, and exterior portion 140, as shown. The geometry and dimensions of base housing portion 130 preferably can also be selected, preferably according to the geometry and dimensions of upper housing portion 110. Base housing portion 130 further preferably comprises support members 142 (at least embodying herein wherein such at least one lower housing comprises at least one first support structured and arranged to support such at least one upper housing; and, at least embodying herein wherein such lower housing means comprises support means for supporting such upper housing means), arranged for example to provide support to upper housing portion 110, while upper housing portion 110 removably rests atop base housing portion 130, as shown.

Upper housing portion 110 preferably comprises a longitudinal dimension A of between about twenty-four to about twenty-five inches, preferably about twenty-four and one-quarter inch. Upper housing portion 110 preferably comprises a transverse dimension F (see FIG. 6) of between about fifteen inches to about sixteen inches, preferably about fifteen and one-quarter inch. Upper housing portion 110 preferably comprises a height B of about three inches.

Preferably, (as shown best on FIG. 9) base housing portion 130 has a longitudinal dimension X of between about twenty-four to about twenty-five inches, preferably about twenty-four and one-quarter inch. Base housing portion 130 preferably comprises a transverse dimension Y of between about fifteen to about sixteen inches, preferably about fifteen and one-quarter inch. Base housing portion 130 preferably comprises a height Z of about 4½ inches.

At least one motor 144 preferably is securably attached to the underside of top 132 of base housing portion 130 within interior cavity 138 of base housing portion 130, as shown. Motor 144 (at least embodying herein wherein such at least one motion-generator comprises at least one motor, having at least one motor crankshaft, capable of generating at least rotational motion) further preferably comprises at least one shaft 146, preferably one shaft 146 extending from motor 144, as shown. Shaft 146 preferably extends through an aperture 148 of top 132 and is capable of spinning radially about its radial axis. Attached to shaft 146 preferably is at least one arm 147, as shown (at least embodying herein at least one lever, attachable to such at least one motor crankshaft and structured and arranged to transfer such rotational motion). Arm 147 preferably has a length of between about one-inch to about two-inches, preferably about one and five-eighths of an inch (at least embodying herein wherein such at least one lever comprises exactly one lever having a length from about one inch to about two inches). Shaft 146 preferably is situate about five inches from end 155, preferably centered on such base housing portion 130, as shown (see FIG. 9). Attached to arm 147 preferably is at least one projecting engager 152 (see FIG. 9). Projecting engager 152 preferably comprises at least one friction reducing feature, such as, for example, a low-friction surface, preferably a wheel, preferably comprising bearings, to reduce friction during operable engagement with motion translator coupling 116, as shown. Projecting engager 152 preferably comprises exactly one projecting engager having a diameter from about one-eighth inch to about two inches. Upon reading this specification, those with ordinary skill in the art will now appreciate that, under appropriate circumstances, considering such issues as design preference, user preferences, marketing preferences, cost, structural requirements, available materials, technological advances, etc., other projecting engager arrangements such as, for example, multiple engagers, larger or smaller engagers, alternate geometric arrangements, etc., may suffice.

Preferably, as motor 144 rotates shaft 146, arm 147 rotates projecting engager 152 (at least embodying herein such at least one lever comprises at least one projecting engager structured and arranged to assist rotational transfer of such rotational motion) and such motion is transferred to motion translator coupling 116 (further described below and shown in FIGS. 3, 4A, 5 and 10) preferably situate on upper housing portion 110, as shown. This arrangement preferably assists transfer of operable motion 108 of FIG. 2A to upper housing portion 110. The above described arrangement at least embodies herein wherein such sleep-assisting apparatus housing means comprises motion-generator means for generating motion to such cradle means; and, at least embodies herein wherein such at least one sleep-assisting apparatus housing comprises at least one motion-generator structured and arranged to generate motion to such at least one cradle.

Aperture 148 of top 132 preferably extends from exterior portion 140 of base housing portion 130 to interior cavity 138 of base housing portion 130, as shown. Aperture 148 preferably is disposed above motor 144 in a location of top 132 which preferably assists motor 144 to provide operable motion 108 (see FIG. 2B) to upper housing portion 110, as shown. Motor 144 further preferably comprises a motion translator 150, inclusive of arm 147, preferably disposed at an end of shaft 146 opposite motor 144, as shown. Motion translator 150 (at least embodying herein wherein such at least one motion-generator comprises at least one motion-transferer structured and arranged to transfer motion to such at least one cradle; and, at least embodying herein wherein such motion-generator means comprises motion-transferer means for transferring motion to such cradle means) preferably translates the rotational spin of shaft 146 into operable motion 108 as shown in FIGS. 2A and 2B. Upon reading this specification, those with ordinary skill in the art will now appreciate that, under appropriate circumstances, considering such issues as design preference, user preferences, marketing preferences, cost, structural requirements, available materials, technological advances, etc., other motion arrangements such as, for example, those motions arranged from longer arms 147, those motions arranged from other locations of such motor shaft, those motions arranged from other locations of such motion translator coupling 116, etc., may suffice.

Upper housing portion 110 further preferably comprises a motion translator coupling 116, as shown (at least embodying herein at least one receiver attached to such at least one upper housing structured and arranged to receive such rotational motion from such at least one lever and transfer such rotational motion to such at least one cradle portion). Motion translator coupling 116 preferably is disposed on the underneath portion 113 of bottom 112, for receiving transferred operable motion 108 provided by motor 144, as shown. The above arrangement at least embodies herein such at least one receiver is structured and arranged to receive such at least one projecting engager.

Upper housing portion 110 further preferably comprises blocking 120, disposed on underneath portion 113, preferably on an end opposite motion translator coupling 116, as shown. Base housing portion further preferably comprises base housing supports 158 structured and arranged to provide support to apparatus 102 when placed upon a surface, as shown. Base housing supports 158 preferably comprises material comprising a cushioned, rigid, soft, non-slip, or other suitable material that preferably does not cause damage to any surface apparatus 102 it is placed upon. Base housing supports 158 are preferably situate about one-inch from each outside corner of one respective side opposed to handle 166, so as to allow cushioned support when placed on a planar surface and in the hand-carrying modality, as shown.

Figure 4A:
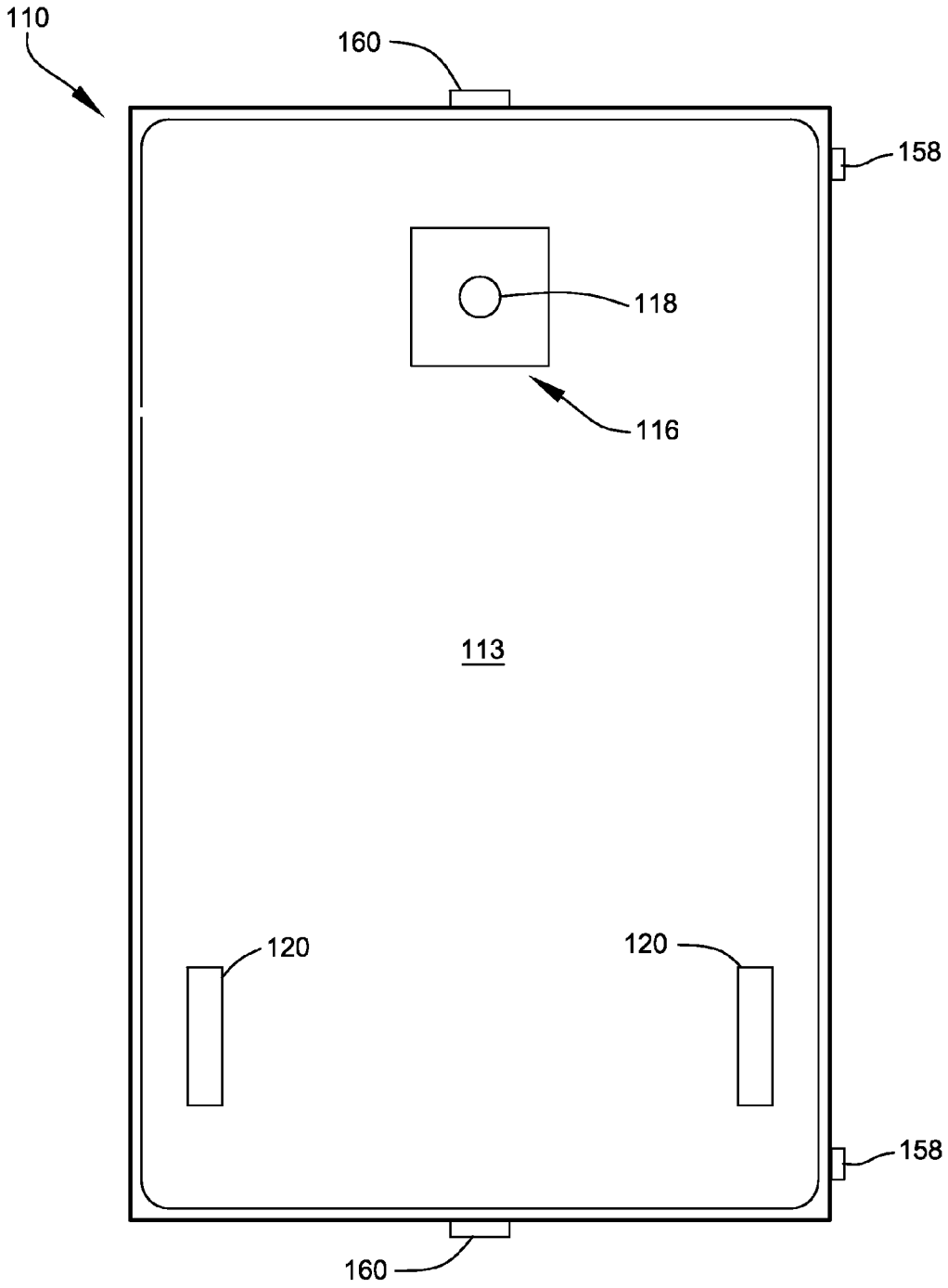
FIG. 4A shows a top view, illustrating a preferred underneath side of the bottom of the upper housing portion of the apparatus of the baby comfort systems, according to the preferred embodiment of FIG. 1.
Figure 4B:
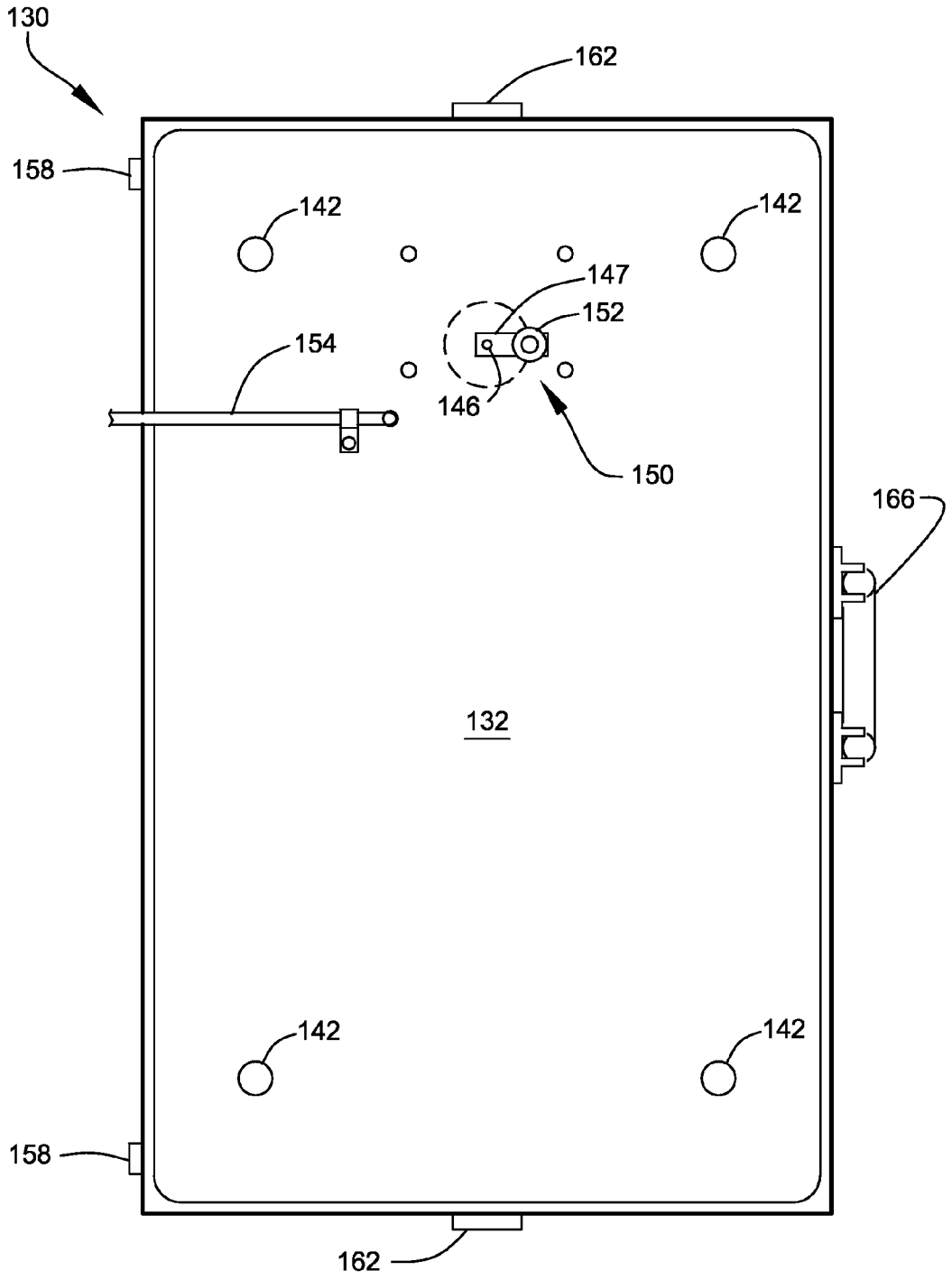
FIG. 4B shows a top view, illustrating a top of a base housing portion of the apparatus of the baby comfort systems, according to the preferred embodiment of FIG. 1.

FIG. 4A shows a top view, of underneath portion 113 of upper housing portion 110 of apparatus 102 of baby comfort system 100, according to the preferred embodiment of FIG. 1. FIG. 4B shows a top view, illustrating top 132 of base housing portion 130 of apparatus 102 of baby comfort system 100, according to the preferred embodiment of FIG. 1.

Motion translator coupling 116 preferably comprises a concave receiving portion 118, structured and arranged to receive projecting engager 152 of base housing portion 130. Motion translator coupling 116 preferably comprises a square piece of hard material, preferably wood, preferably about three-inches square, as shown. Upon reading this specification, those with ordinary skill in the art will now appreciate that, under appropriate circumstances, considering such issues as design preference, user preferences, marketing preferences, cost, structural requirements, available materials, technological advances, etc., other motion translator coupling 116 material arrangements such as, for example, metal, plastic, ceramic, etc., may suffice.

Centered in such three-inches square motion translator coupling 116 preferably is a receiving portion 118 comprising a single circular cut-out, preferably having a diameter of about one-inch (preferably about the same diameter as projecting engager 152). Upon reading this specification, those with ordinary skill in the art will now appreciate that, under appropriate circumstances, considering such issues as design preference, user preferences, marketing preferences, cost, structural requirements, available materials, technological advances, etc., other transferred operable motion 108 to translator coupling 116 arrangements such as, for example, larger or smaller dimensions, more than one translator, longer or shorter shaft arrangements, etc., may suffice.

Support members 142 preferably are structured and arranged near each corner of top 132 of base housing portion 130, as shown. Preferably, support members 142 are located about three inches from each transverse end and about two and a half inches from each respective longitudinal side, as shown. Upon reading this specification, those with ordinary skill in the art will now appreciate that, under appropriate circumstances, considering such issues as design preference, user preferences, marketing preferences, cost, structural requirements, available materials, technological advances, etc., other support member arrangements such as, for example, fewer or greater supports, other placements, etc., may suffice.

Blocking 120 preferably is disposed near the corners of the underneath side of bottom 112 on an end opposite the motion translator coupling 116, as shown. Blocking 120 preferably comprises at least about a quarter-inch thick material, about three-quarters inch in width, and about three inches in length. Blocking 120 preferably is located about one and one-quarter inch from each longitudinal side and about two and a half inches in from the respective transverse opposed end 155, as shown (see FIG. 4A). Blocking 120 preferably is situate just to the outer edge of each of the two respective support members 142. Blocking 120 preferably is further structured and arranged to assist keeping upper housing portion 110 upon base housing portion 130 during side motion operation. Blocking 120 preferably is further structured and arranged to assist the preferred specific motion of operable motion 108, as shown in FIG. 2. Blocking 120 preferably assists in translating radial spin of shaft 146 by limiting the range of motion of upper housing portion 110 as upper housing portion 110 contacts with support members 142, as shown.

To assist carrying of such apparatus when coupled together in a carrying modality (as described and shown herein), upper housing portion 110 further preferably comprises first locking members 160, as shown in FIG. 4A. Base housing portion 130 preferably comprises second locking members 162 (see FIG. 4B), capable of connectably communicating with first locking members 160, as shown (this arrangement at least embodies herein wherein such sleep-assisting apparatus housing means comprises lock means for locking such upper housing means and such lower housing means together). Upper housing portion 110 further preferably comprises handle 166 for carrying apparatus 102 when first locking members 160 and second locking members 162 are in communication. Alternately preferably, base housing portion 130 further comprises handle 166 for carrying apparatus 102 when first locking members 160 and second locking members 162 are in communication (see FIG. 1).

Figure 5:
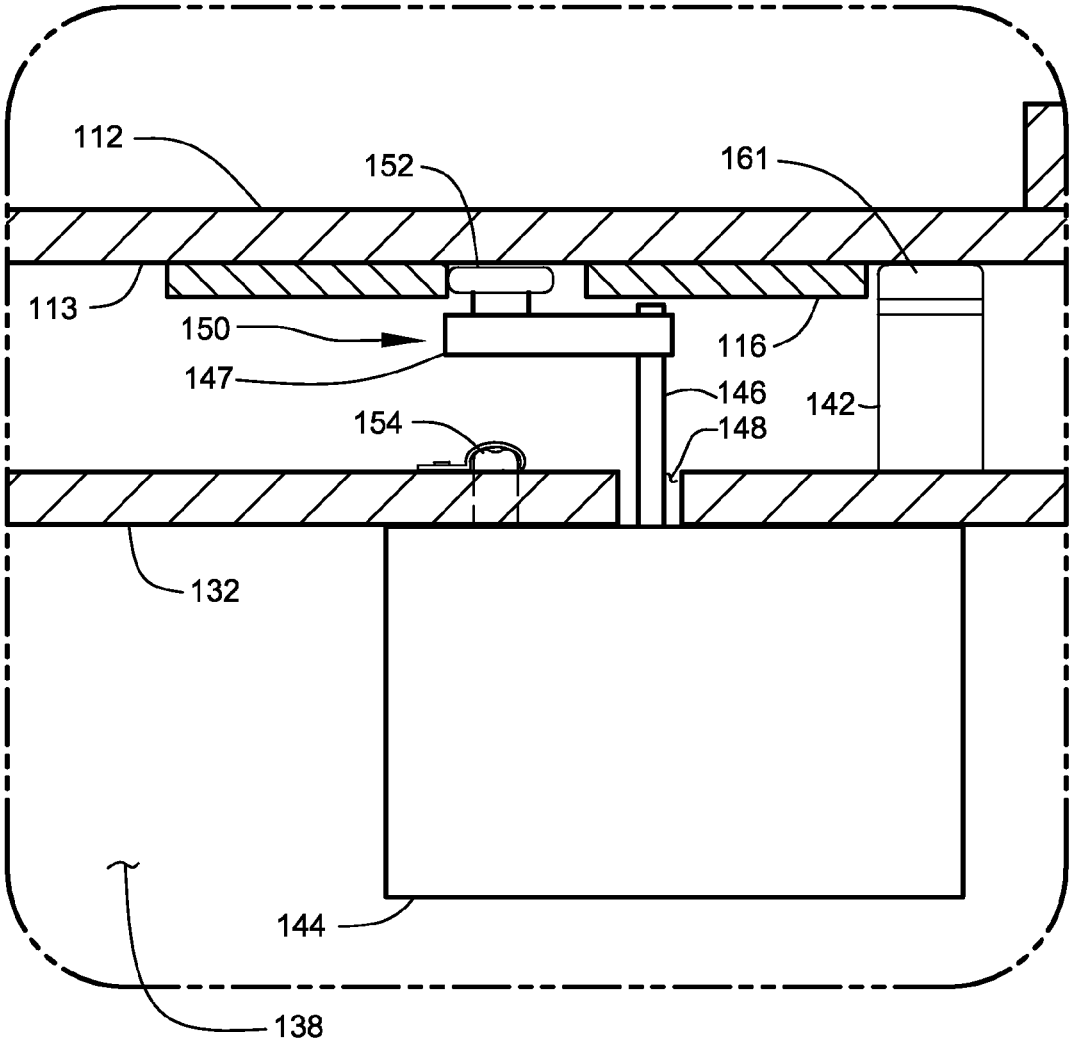
FIG. 5 shows a close-up view, illustrating a motion translator of the apparatus of the baby comfort systems, according to the preferred embodiment of FIG. 1.

FIG. 5 shows a close-up view of motion translator 150 of apparatus 102 of baby comfort system 100, according to the preferred embodiment of FIG. 1. Motion translator 150 preferably comprises projecting engager 152 preferably disposed at an end of the motion translator 150 opposite shaft 146, as shown. Support members 142, preferably are structured and arranged to provide support to upper housing portion 110, while upper housing portion 110 removably rests atop base housing portion 130. Support members 142 preferably are made from a suitable material, such as a rigid material, preferably hard plastic, capable of providing support to upper housing portion 110. Additionally, support members 142 preferably comprise a low friction material at the contact point 161 of support members 142 with the underside portion of bottom 112 of upper housing portion 110.

Figure 6:
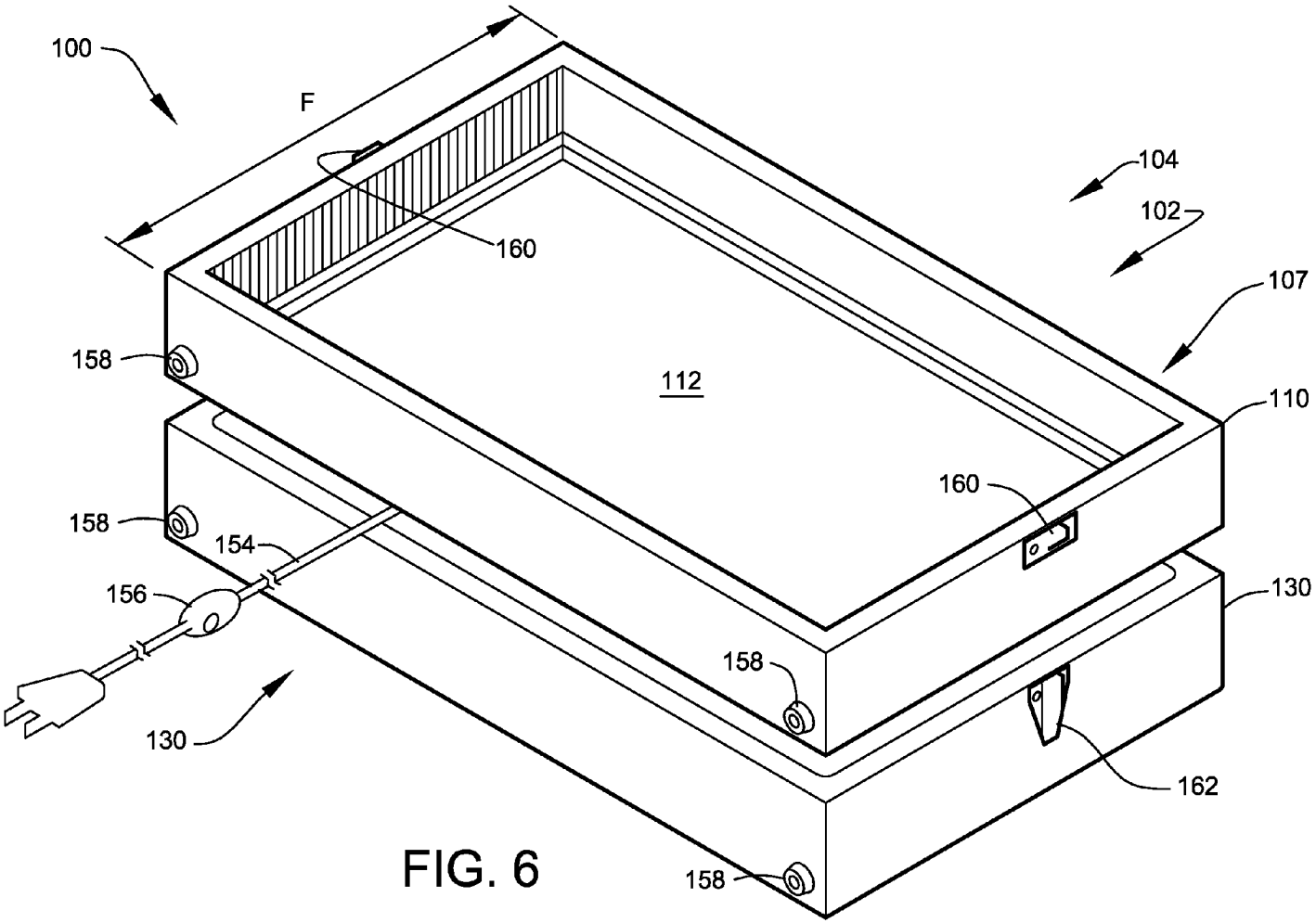
FIG. 6 shows a perspective view, illustrating an operable position of the apparatus of the baby comfort systems, according to the preferred embodiment of FIG. 1.
Figure 7:
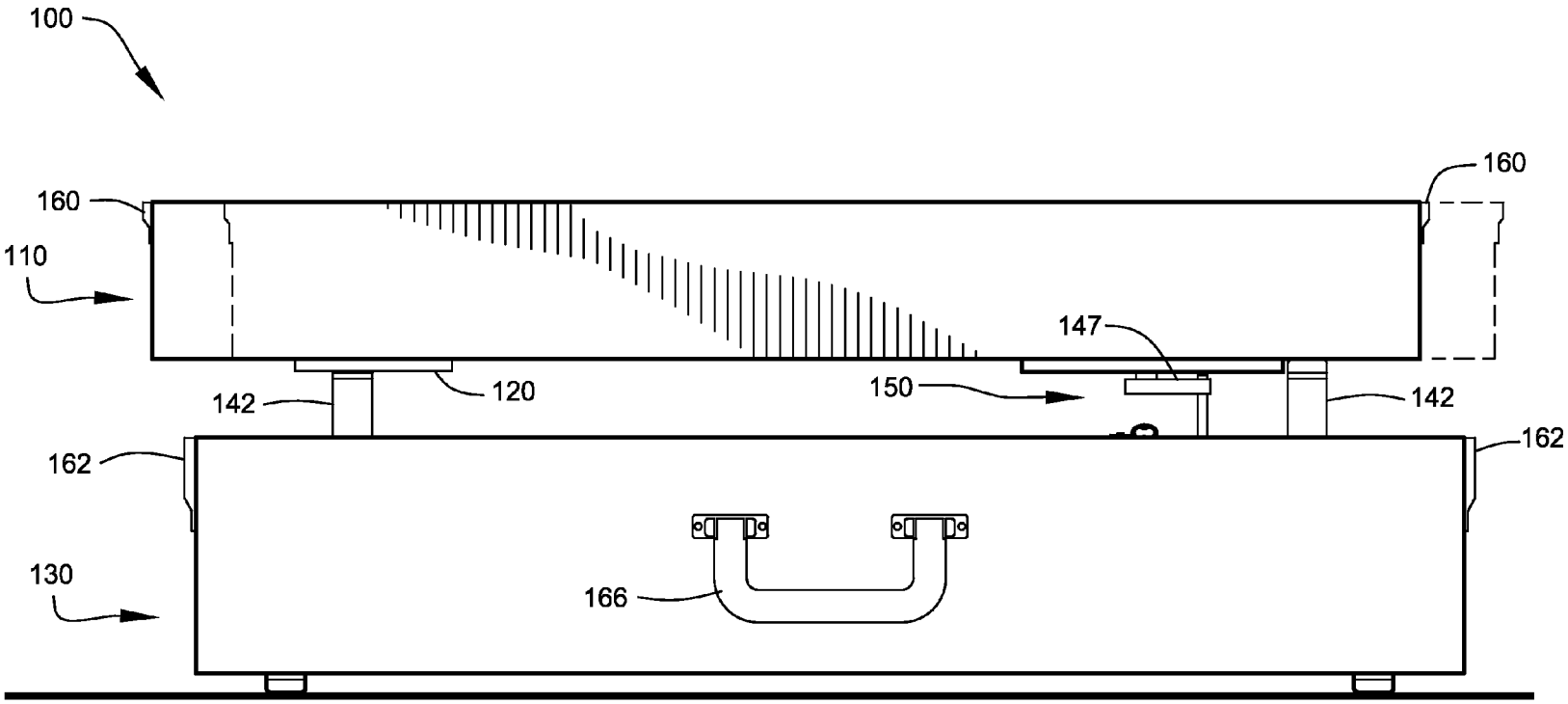
FIG. 7 shows a side view, illustrating the apparatus of the baby comfort systems in an operable position, according to the preferred embodiment of FIG. 1.

FIG. 6 shows a perspective view illustrating operable position 104 of apparatus 102 of baby comfort systems 100, according to the preferred embodiment of FIG. 1. FIG. 6 shows baby carrier 106 unattached from bottom 112. FIG. 7 shows a side view of apparatus 102 of baby comfort system 100 in operable position 104, according to the preferred embodiment of FIG. 1. In operable position 104, upper housing portion 110 preferably is capable of being removably situated upon base housing portion 130, as shown. When situated upon base housing portion 130, upper housing portion 110 may be radially and linearly offset in relation to base housing portion 130, when in operable motion 108 (see FIG. 2).

Additionally, apparatus 102 preferably further comprises a "safety" securing member, (such as, for example, a cable connected between such portions when operating) for securing upper housing portion 110 to base housing portion 130 when in operable position 104, such that upper housing portion is selectively non-removable from base housing portion 130 during operation of baby comfort systems 100. Upon reading this specification, those with ordinary skill in the art will now appreciate that, under appropriate circumstances, considering such issues as design preference, user preferences, marketing preferences, cost, structural requirements, available materials, technological advances, etc., other safety securing members arrangements such as, for example, straps, wire, rope, magnetic attachers, etc., may suffice.

Figure 8:
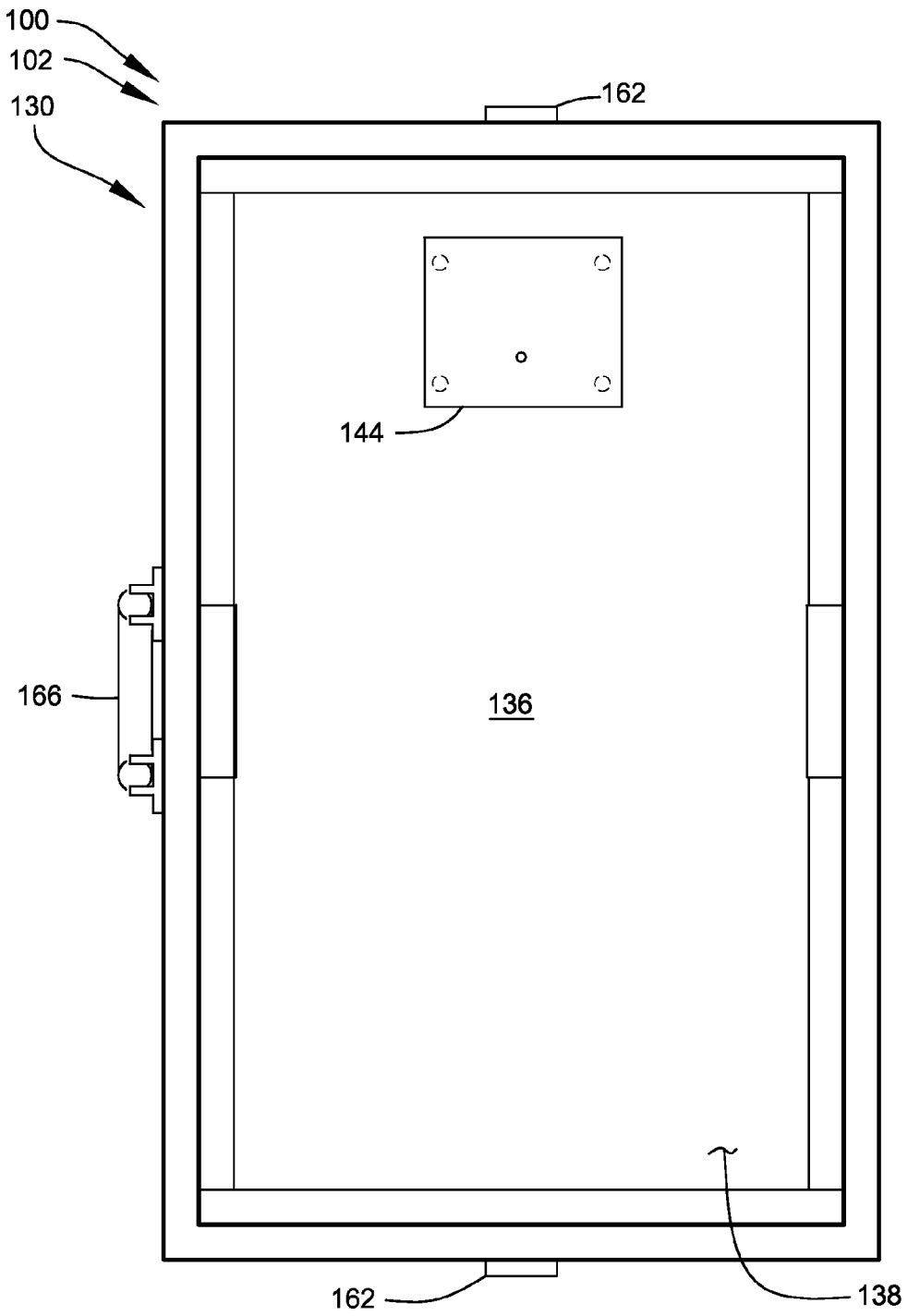
FIG. 8 shows a top view, illustrating an interior cavity of a lower base portion of the apparatus of the baby comfort systems, according to the preferred embodiment of FIG. 1.

FIG. 8 shows a top view of interior cavity 138 of lower base portion 130 of apparatus 102 of baby comfort system 100, according to the preferred embodiment of FIG. 1. In FIG. 8, bottom 136 (see FIG. 3) is removed to allow a visual depiction of interior cavity 138.

Motor 144 preferably is securably attached to the underside of top 132 of base housing portion 130 within interior cavity 138 of base housing portion 130, as shown. During operation of apparatus 102, bottom 136 preferably remains attached to base housing portion 130. Additionally, during operation, motor 144 preferably acts as a vibrator-assistor wherein motor 144 provides vibrations to base housing portion 130 and upper housing portion 110. Additionally, during operation, motor 144 preferably comprises a sound-assistor wherein motor 144 provides an audible sound, and wherein interior cavity 138 provides resonate space for such audible sound to resonate (this arrangement at least embodies herein wherein such at least one motor comprises at least one motor sounder structured and arranged to cause sound vibration sufficient to vibrate such at least one cradle portion). For example, when audible sound resonates within internal cavity 138, base housing portion 130 acts as a speaker enhancing such sound (this arrangement at least embodies herein wherein such at least one lower housing is structured and arranged to enhance sound-vibration from such at least one motor sounder). Applicant has determined that the vibration and sounds assist such baby comforting in addition to such motion. Preferably, the preferred gear motor provides such vibration (preferred motor 144), however, other vibration mechanisms that mimic such motor vibration, may suffice (this arrangement at least embodies herein wherein such at least one motor comprises at least one motor vibrator structured and arranged to cause vibration sufficient to vibrate such at least one cradle portion). Further, gear motor sounds preferably are used, however, other sound mechanisms that produce sound mimicking such motor hertz may suffice. Preferably, sound is similar to that produced by such vibration of such motor 144 preferably between about thirty Hertz and about two-hundred and forty Hertz, preferably about sixty Hertz.

Motor 144 preferably is structured and arranged to radially spin shaft 126 at a fixed rate, alternatively preferably at an adjustable rate. Motor 144 preferably comprises an AC current gear motor with a parallel shaft, preferably capable of about fifty revolutions per minute (RPM), preferably having full load torque at about twelve inches per pound, preferably having a voltage rating of about 115 Volts. Motor 144 preferably comprises an input horsepower (HP) of about 1/60 HP and preferably comprises a gear ratio of about 64:1 with all position mounting as available from 'Grainger' [http://www.grainger.com/Grainger/DAYTON-AC-Gearmotor-4Z147] (item number 4Z147; model number HGM-4050-8). Upon reading this specification, those with ordinary skill in the art will now appreciate that, under appropriate circumstances, considering such issues as design preference, user preferences, marketing preferences, cost, structural requirements, available materials, technological advances, etc., other motor types such as, for example, motors with different voltages, motors with higher or lower HP, motors with different gear ratios, motors with different torque arrangement, etc., may suffice.

Figure 9:
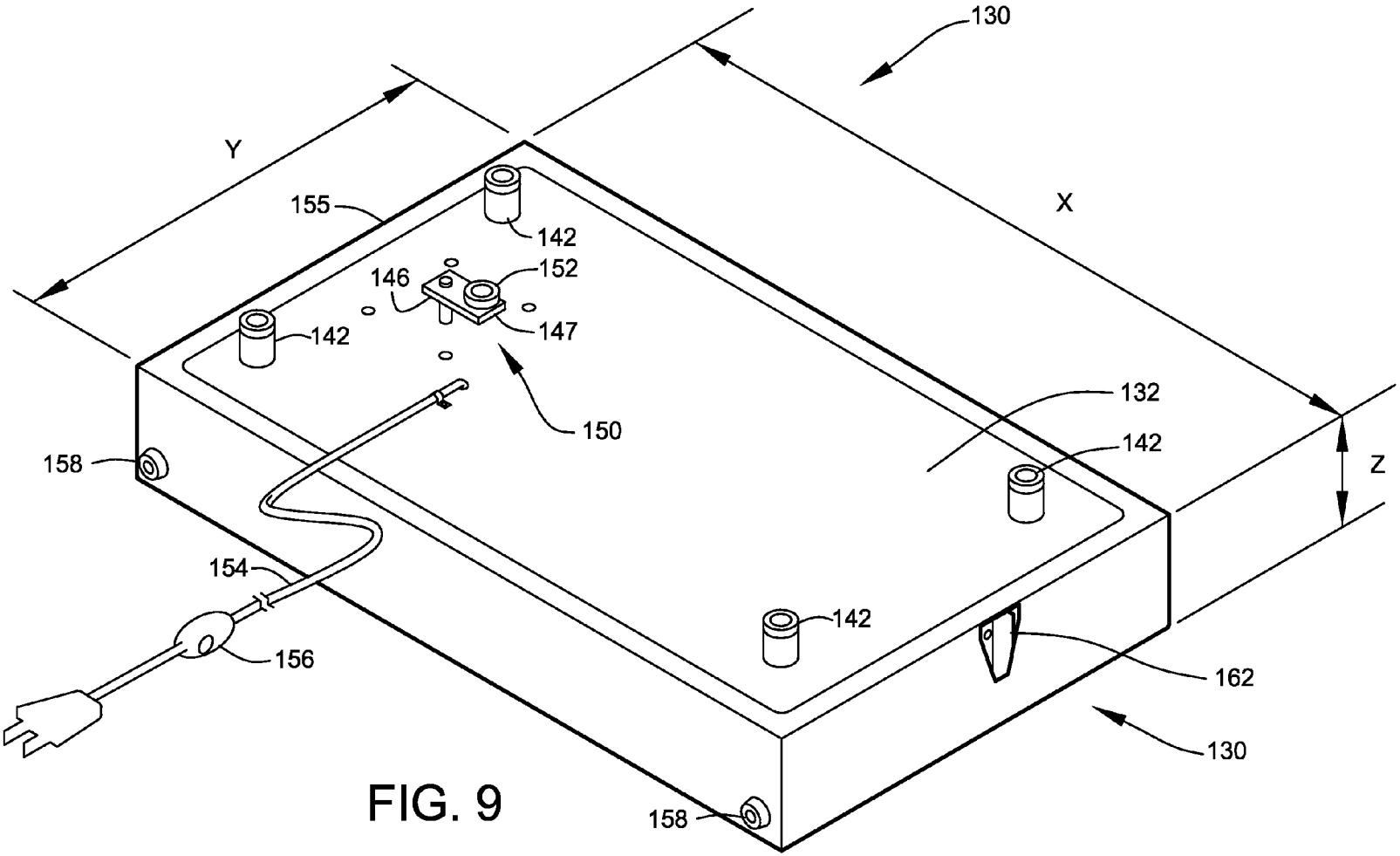
FIG. 9 shows a perspective view, of a lower base portion of the apparatus of the baby comfort systems, according to the preferred embodiment of FIG. 1.

FIG. 9 shows a perspective view of base housing portion 130 of apparatus 102 of baby comfort system 100, according to the preferred embodiment of FIG. 1. Motor 144 preferably comprises an on/off switching-mechanism which preferably is capable of being externally accessed from outside of interior cavity 138 (at least embodying herein wherein such motion-generator means comprises controller means for assisting user-control of at least one on/off motion control; and, at least embodying herein wherein such at least one motion-generator comprises at least one controller structured and arranged to assist user-control of at least one on/off motion control). On/off switching-mechanism preferably may comprise a switch 156 disposed on a cord 154 extending from interior cavity 138 to exterior portion 140, as shown. Additionally, switch 156 may be fixedly attached to an outer portion of base housing portion 130. Upon reading this specification, those with ordinary skill in the art will now appreciate that, under appropriate circumstances, considering such issues as design preference, user preferences, marketing preferences, cost, structural requirements, available materials, technological advances, etc., other on/off arrangements such as, for example, wireless control, wall switch, multiple switches (to control motion, sound and or speed), etc., may suffice.

Figure 10:
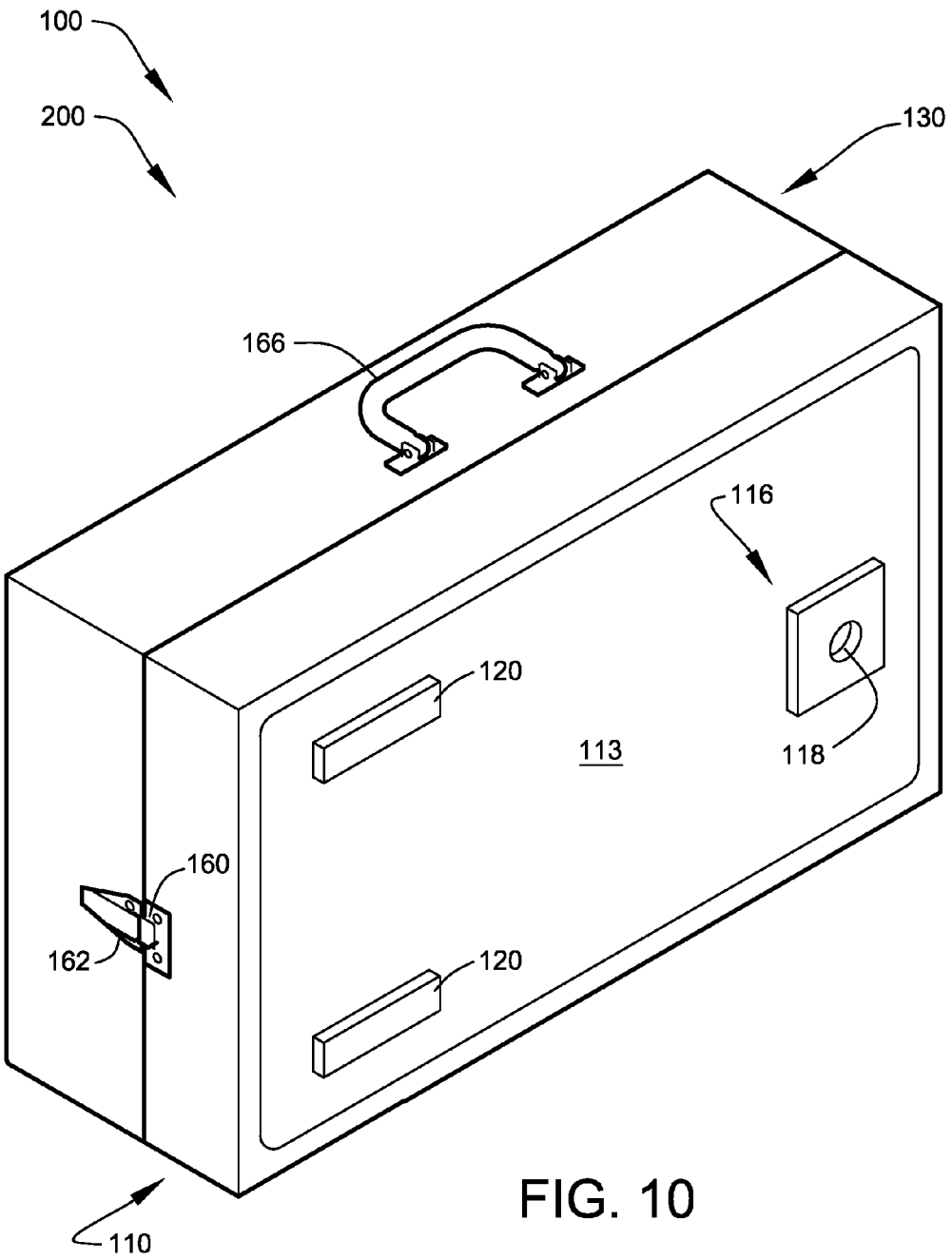
FIG. 10 shows a perspective view, illustrating the apparatus of the baby comfort systems in a preferred hand-carryable position, according to a preferred embodiment of the present invention.

FIG. 10 shows a perspective view, illustrating apparatus 102 of baby comfort systems 100 in a preferred hand-carryable position 200, according to the preferred embodiment of FIG. 1. While in hand-carryable position 200, upper housing portion 110 preferably is flipped so cradle portion 107 is interior and underneath portion 113 is the cover. Preferably, upper housing portion 110 and base housing portion 130 together comprise a box geometry comprising two half-box sections structured and arranged to be removably coupled into such one box geometry, as shown. Hand-carryable position 200 preferably allows apparatus 102 portability and safety. While in hand-carryable position 200, upper housing portion 110 preferably rests upon base housing portion 130 in an upside-down orientation with sidewalls 114 in contact with base housing portion 130, as shown. While in hand-carryable position 200, first locking members 160 and second locking members 162 preferably are capable of connectable communication to secure upper housing portion 110 and base housing portion 130 together.

First locking members 160 and second locking members 162 may comprise a latch system, a bolt system, a pin system, a fastener system, a clip system, a tie system, a closure system, or similar securing system capable of securably connecting upper housing portion 110 to base housing portion 130 when apparatus 102 is in hand-carryable position 200. While upper housing portion 110 and base housing portion 130 are securably connected, motor 144 of FIG. 3 preferably cannot provide operable motion 108 to upper housing portion 110, even if motor 144 is engaged. Preferably, base housing portion 130 further comprises handle 166 for assisting carrying apparatus 102. The above-described arrangement at least embodies herein wherein such sleep-assisting apparatus housing means comprises hand-carryable element means for assist hand-carrying of such sleep-assisting apparatus housing means; and, at least embodies herein wherein such at least one sleep-assisting apparatus housing comprises at least one hand-carryable element structured and arranged to assist hand-carrying of such at least one sleep-assisting apparatus housing.

FIG. 11 through FIG. 22 illustrates alternate apparatus 300 of baby comfort systems 100, according to another preferred embodiment of the present invention. Table 1 associates preferred the embodiment components with the component reference numbers provided within the accompanying illustrations. Table 1 also provides a listing of preferred component materials and quantities.

TABLE 1

| Component No. | Quantity | Preferred Components Descriptions |
|---|---|---|
| CASE PARTS | | |
| 302 | (1) | UPPER TRAY BOTTOM - ¼"MAPLE PLYWOOD |
| 304 | (2) | UPPER TRAY LONG SIDE - ½" MAPLE PLYWOOD |
| 306 | (2) | UPPER TRAY SHORT SIDE - ½" MAPLE PLYWOOD |
| 308 | (2) | TRAY GUIDE - ½" MAPLE PLYWOOD |
| 310 | (1) | LOWER TRAY BOTTOM - ¼" MAPLE PLYWOOD |
| 312 | (2) | LOWER TRAY LONG SIDE - ½" MAPLE PLYWOOD |
| 314 | (2) | LOWER TRAY SHORT SIDE - ½" MAPLE PLYWOOD |
| 316 | (4) | CORNER BLOCK - ⅜" MAPLE PLYWOOD |
| 318 | (2) | STOP BLOCKS - ⅝" MAPLE LUMBER |
| 320 | (1) | LOWER TRAY TOP - ¼" MAPLE PLYWOOD |
| HARDWARE GROUP | | |
| 322 | (1) | CAM RECEIVER with MACHINED DELRIN PART DESIGNED TO CAPTURE ECCENTRIC CAM |
| 324 | (4) | FURNITURE GLIDE (HAFELE PART #650.19.324) |
| 326 | (1) | PULL APART HINGE (SOUTHCO 96-50-510-50) |
| 328 | (4) | FURNITURE GLIDE (HAFELE PART #650.19.324) |
| 330 | (4) | #8 × ¾" WOOD SCREW |
| 332 | (1) | DRAW LATCH (SOUTHCO V7-20-101-50) |
| 334 | (1) | ECCENTRIC CAM MACHINED DELRIN PART DESIGNED TO LOCK INTO CAM RECEIVER |
| 336 | (1) | STRAP HANDLE (GRUNDORF 31-07) |
| 338 | (4) | STAND-OFF CUSTOM MACHINED DELRIN PART TO SUPPORT UPPER TRAY MOTION |
| 340 | (6) | VENT PLUG (AEROSPACE SOUTHWEST nPLV003A) |
| ELECTRICAL GROUP | | |
| 342 | (1) | ELECTRICAL RECEPTACLE (QUALTEK 703W-00/8) |
| 344 | (1) | COUNTDOWN TIMER 30 MINUTE (WOODS 59007) |
| 346 | (1) | DAYTON 5CFL 5 AC GEAR MOTOR with THERMAL PROTECTION |
| 348 | (1) | WIRE HARNESS with 18-GAUGE STRANDED WIRE |

As the preferred structures and functional arrangements of the following alternate embodiment are fundamentally the same as those of apparatus 102, only the differences will be elaborated upon. It is further noted that the general dimensional annotations within FIG. 11 through FIG. 22 are provided in Standard English inch units.

Figure 11:
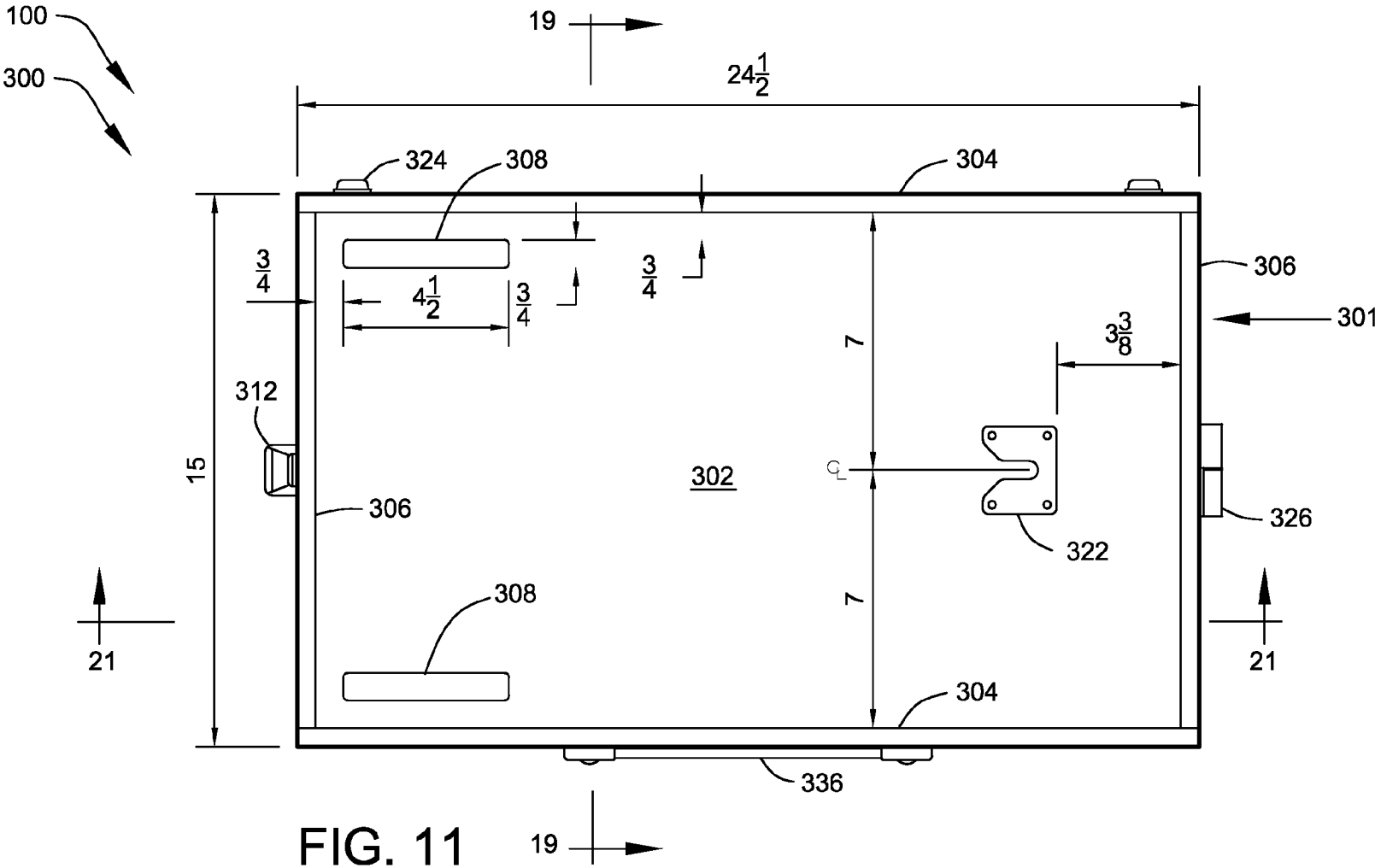
FIG. 11 shows a top view, illustrating an upper cradle portion of an alternate apparatus of the baby comfort systems, according to another preferred embodiment of the present invention.
Figure 12:
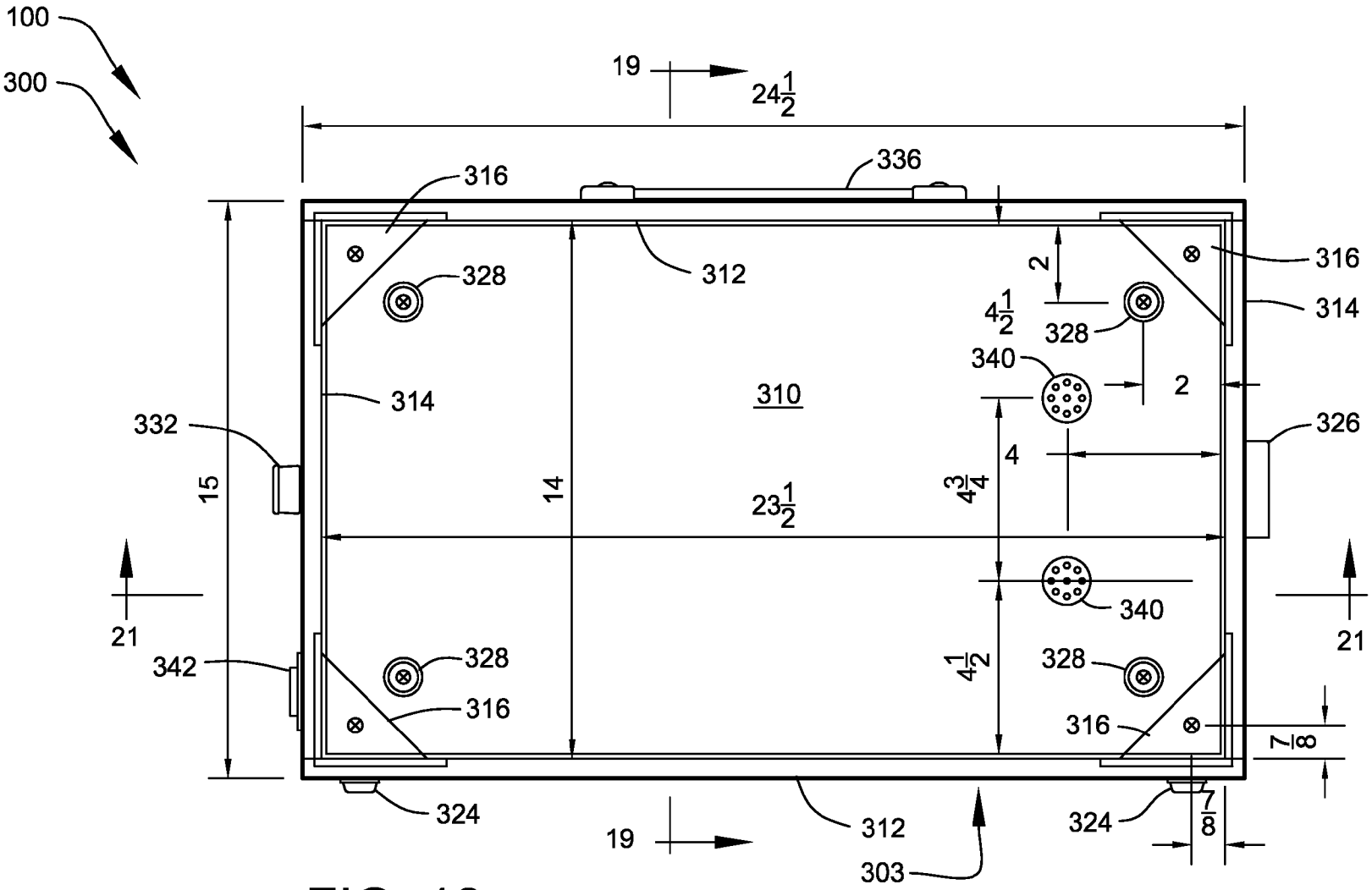
FIG. 12 shows a bottom view, illustrating an alternate base housing portion, according to the preferred embodiment of FIG. 11.
Figure 13:
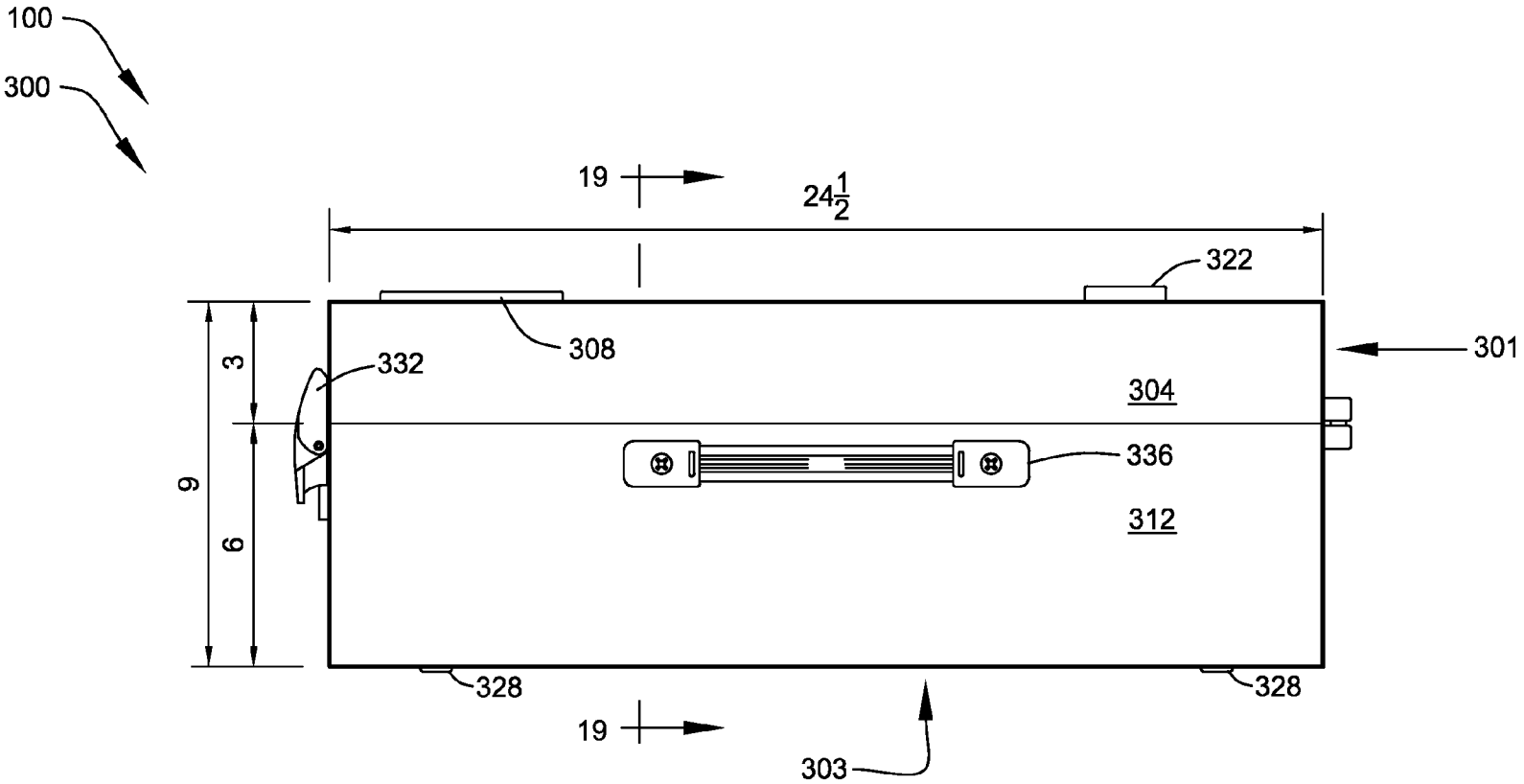
FIG. 13 shows a front view illustrating the alternate apparatus of FIG. 11 in a closed configuration.
Figure 14:
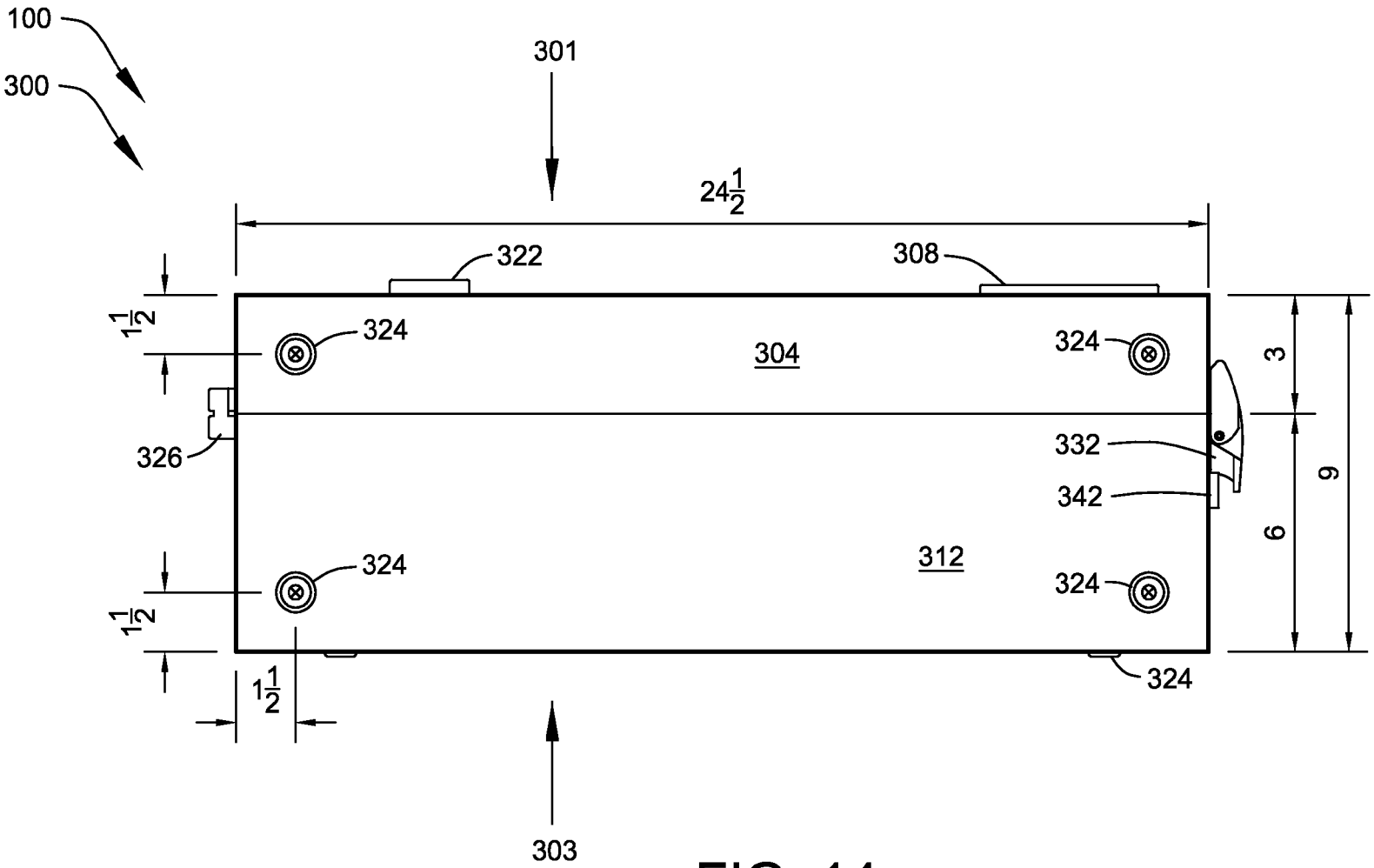
FIG. 14 shows a front view illustrating the alternate apparatus of FIG. 11 in a closed configuration.
Figure 15:
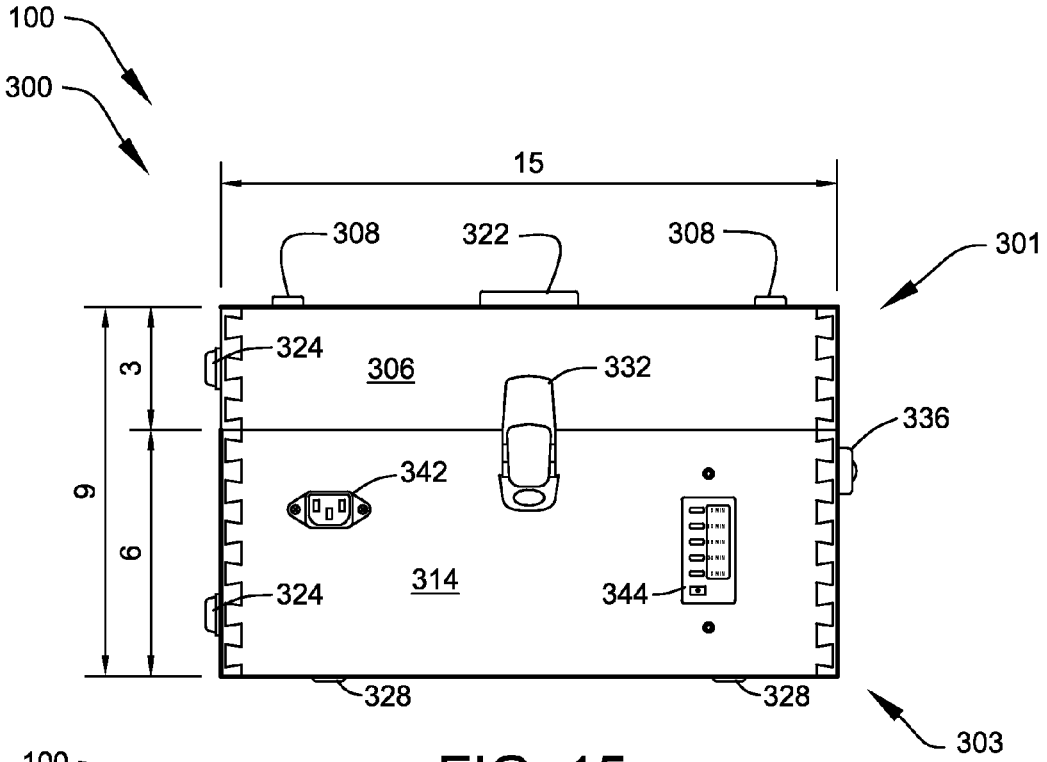
FIG. 15 shows a left-end view of the alternate apparatus of FIG. 11 in a closed configuration.

FIG. 11 shows a top view, illustrating upper cradle portion 301 of alternate apparatus 300. FIG. 12 shows a bottom view, illustrating preferred features of alternate base housing portion 303, according to the preferred embodiment of FIG. 11. FIG. 13 shows a front view illustrating alternate apparatus 300 in a closed configuration for transport and storage. FIG. 14 shows a front view illustrating alternate apparatus 300, also in the closed configuration. FIG. 15 shows a left-end view of alternate apparatus 300, also in the closed configuration.

Figure 16:
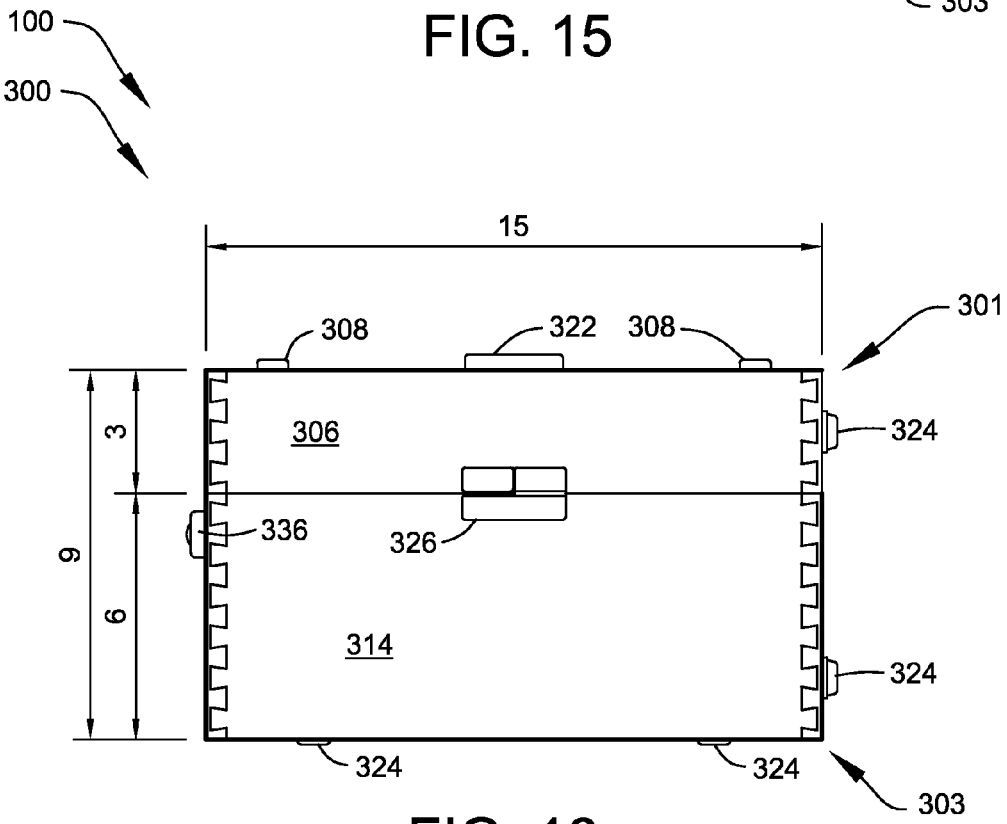
FIG. 16 shows a right-end view of the alternate apparatus of FIG. 11 in a closed configuration.
Figure 17:
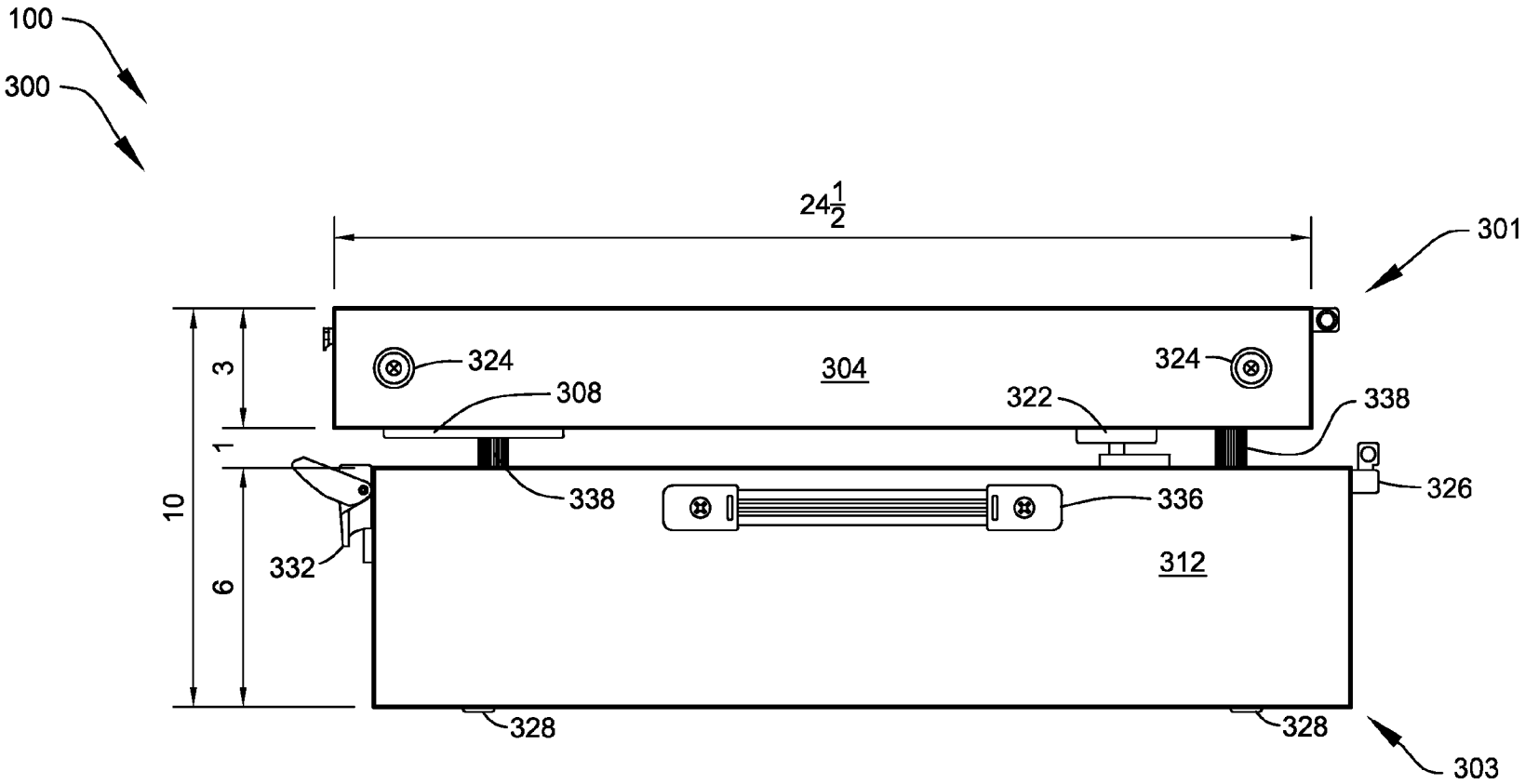
FIG. 17 shows a front view illustrating the alternate apparatus of FIG. 11 in an open configuration.
Figure 18:
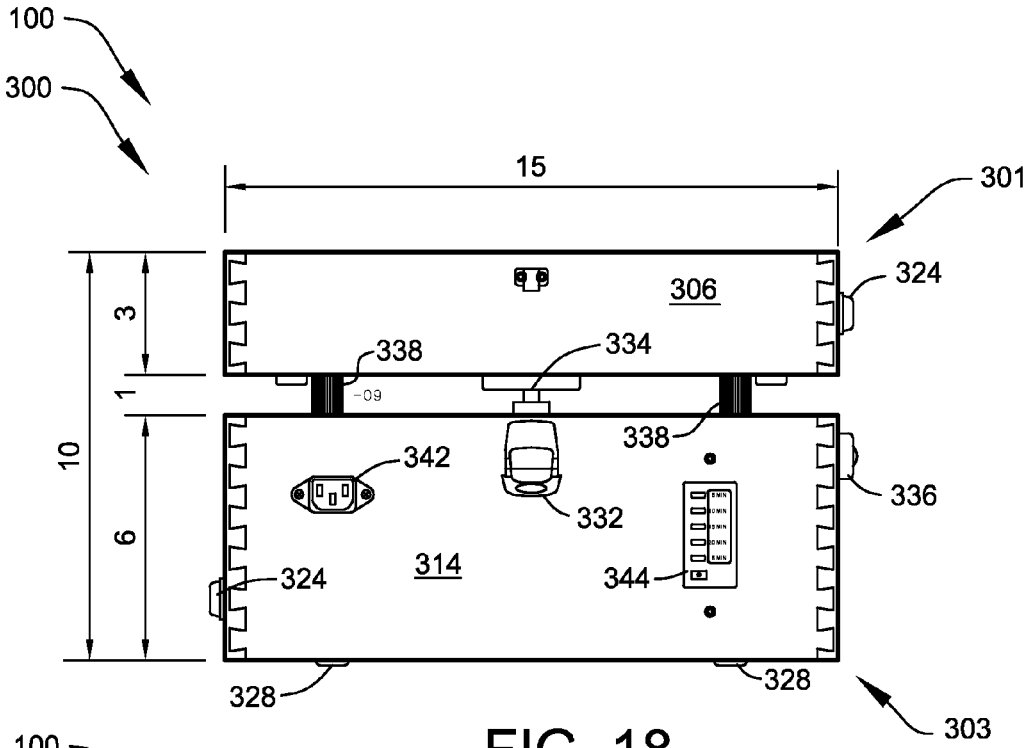
FIG. 18 shows a left-end view of the alternate apparatus of FIG. 11 in an open configuration.

FIG. 16 shows a right-end view of alternate apparatus 300 in the closed configuration. FIG. 17 shows a front view illustrating the alternate apparatus 300 separated and arranged in an open (operable) configuration. FIG. 18 shows a left-end view of the alternate apparatus 300 in the open configuration. Visible in FIG. 18 is preferred electrical receptacle 342, as shown. Electrical receptacle 342 permits the energizing of the device by connection to an external electrical power source, preferably by means of a detachable electrical cable. Electrical receptacles suitable for use as electrical receptacle 342 include model 703 W-00/8 supplied by QUALTEK of Mentor Ohio. Electrical receptacle 342 is preferably adapted to receive line-voltage alternating current.

Also visible in FIG. 18 is a preferred countdown timer 344 provided to automatically limit the timed operation of the unit to a user-defined duration. Countdown timer 344 is preferably integrated within wire harness 348 so as to enable a timed control of electrical current flowing between electrical receptacle 342 and gear motor 346. Countdown timer 344 is preferably of a type that permits user-selectable operational durations between 5 minutes and 30 minutes. Preferred countdown timers, suitable for use as countdown timer 344, preferably include WOODS model 59007 supplied by Coleman Cable, Inc. of Waukegan, Ill.

Figure 19:
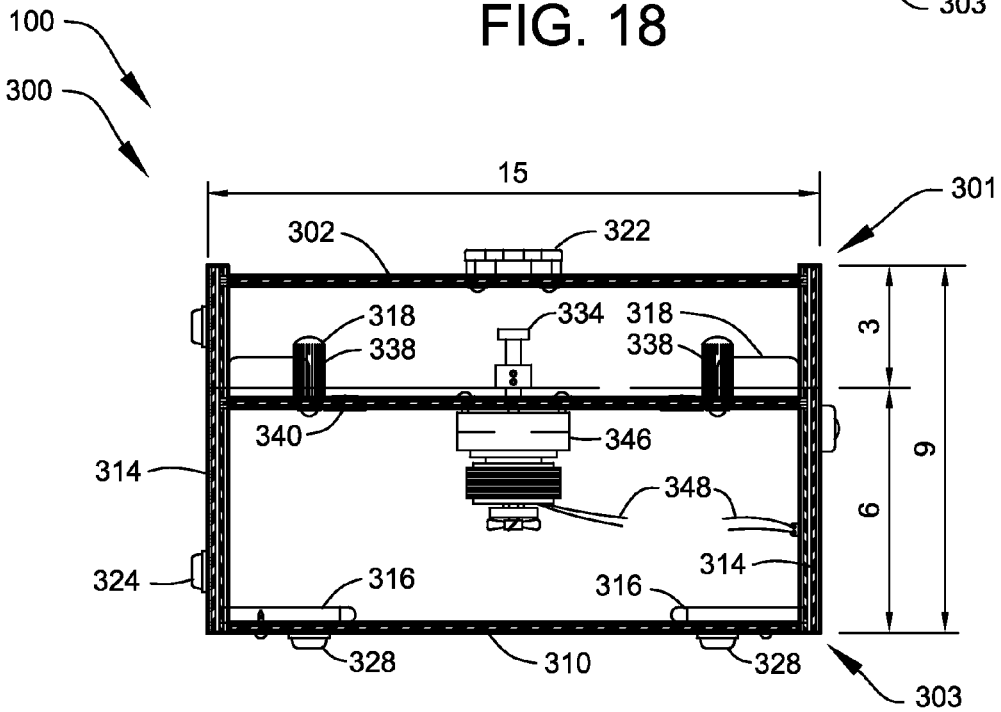
FIG. 19 shows a sectional view, through the section 19-19 of FIG. 11, illustrating the internal arrangements of the alternate apparatus in the closed configuration.
Figure 20:
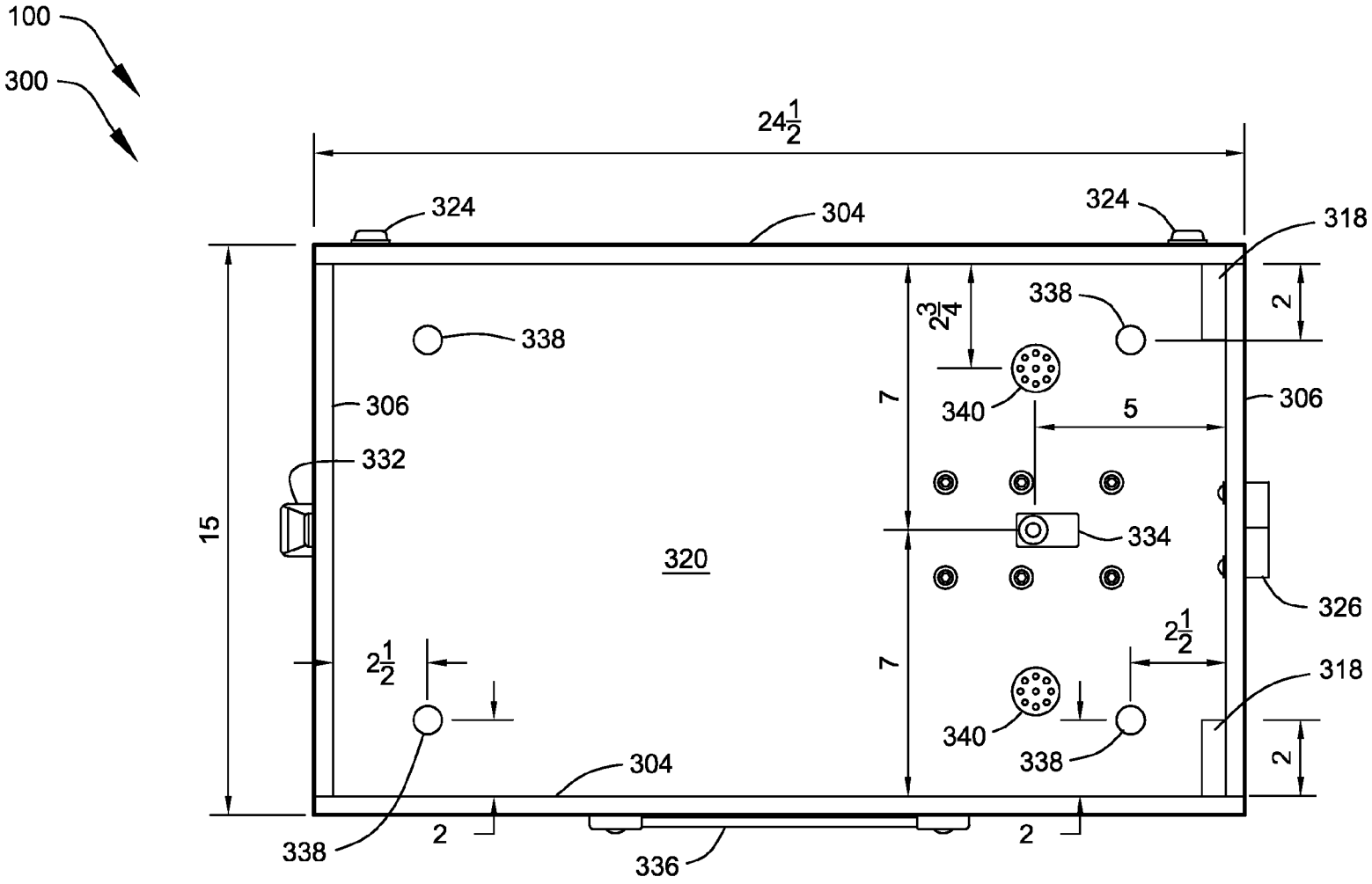
FIG. 20 shows a top view, illustrating the alternate base housing portion with the upper cradle portion removed.

FIG. 19 shows a sectional view, through the section 19-19 of FIG. 11, illustrating the internal arrangements of alternate apparatus 300 when positioned in the closed configuration. FIG. 20 shows a top view, illustrating the alternate base housing portion 303 with the upper cradle portion 301 removed.

Figure 21:
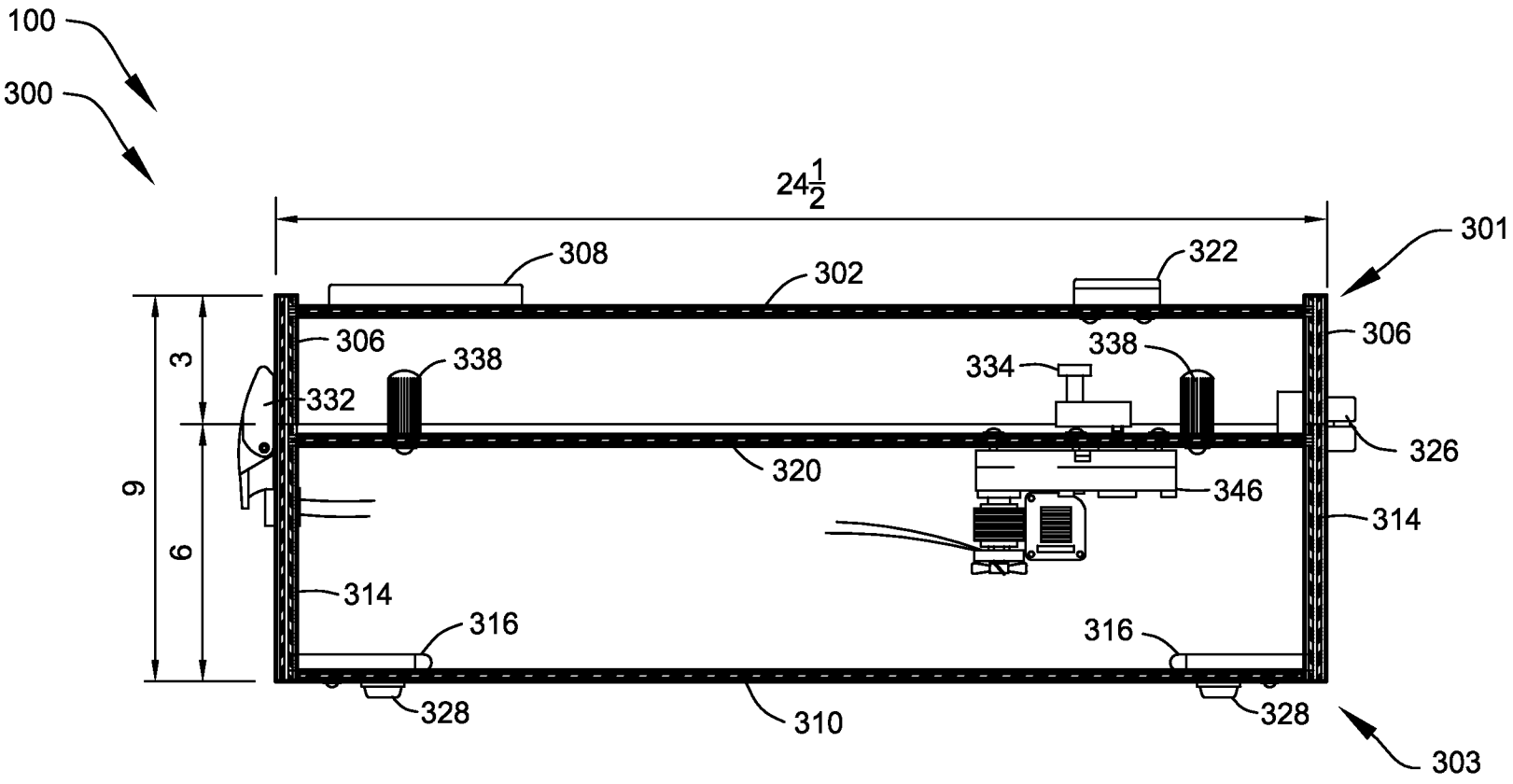
FIG. 21 shows a sectional view, through the section 21-21 of FIG. 11, illustrating the internal arrangements of the alternate apparatus in the closed configuration.
Figure 22:
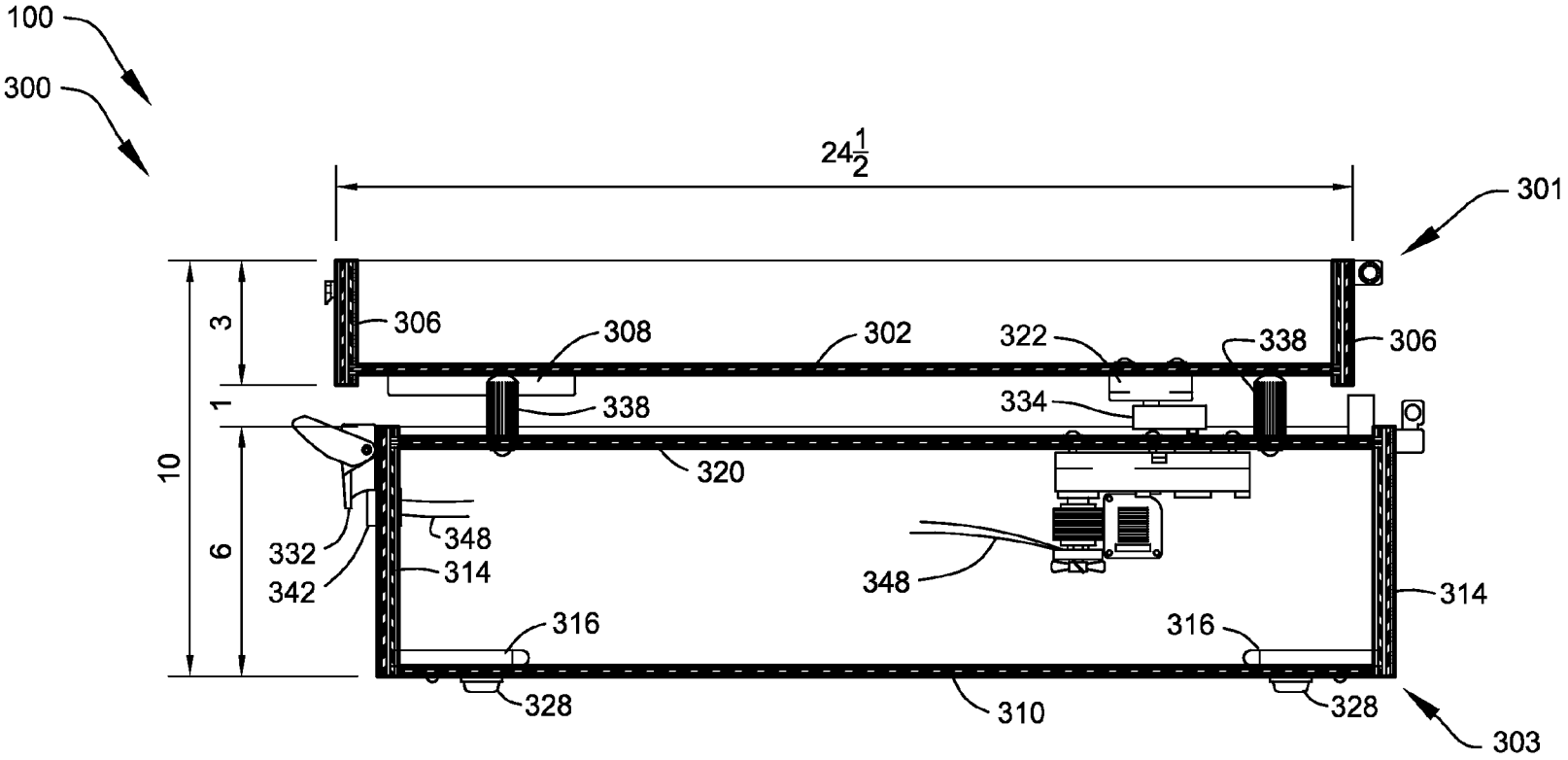
FIG. 22 shows a sectional view, through the section 22-22 of FIG. 18, illustrating the internal arrangements of the alternate apparatus in the open configuration.

FIG. 21 shows a sectional view, through the section 21-21 of FIG. 11, illustrating the internal arrangements of alternate apparatus 300 in the closed configuration. FIG. 22 shows a sectional view, through the section 22-22 of FIG. 18, illustrating the internal arrangements of alternate apparatus 300 in the open configuration.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system, relating to providing a portable sleep-assisting environment to assist sleep of at least one infant in at least one infant carrier, comprising:

a) at least one sleep-assisting apparatus housing structured and arranged to house at least one sleep-assisting apparatus;

b) wherein said at least one sleep-assisting apparatus housing comprises i) at least one lower housing structured and arranged to house lower elements, and ii) at least one upper housing structured and arranged to house upper elements, iii) wherein said at least one upper housing comprises at least one cradle structured and arranged to cradle at least the at least one infant carrier, and iv) wherein said at least one lower housing comprises at least one first support structured and arranged to support said at least one upper housing;

c) wherein said at least one sleep-assisting apparatus housing further comprises at least one separator structured to arrange to separate movement between said at least one lower housing and said at least one upper housing;

d) wherein said at least one sleep-assisting apparatus housing comprises at least one motion-generator structured and arranged to generate motion to said at least one cradle;

e) wherein said at least one motion-generator comprises at least one controller structured and arranged to assist user-control of at least one on/off motion control;

f) wherein said at least one motion-generator comprises at least one motion-transferer structured and arranged to transfer motion to said at least one cradle;

g) wherein said at least one motion-transferer comprises shaft-driven rotary planar to linear planar translational motion elements structured and arranged to impart shaft-driven rotary planar to linear planar translational motion to said at least one cradle when said at least one upper housing is situate upon said at least one lower housing;

h) wherein said shaft-driven rotary planar to linear planar translational motion comprises a compound motion disposed above said at least one lower housing;

i) wherein said compound motion comprises i) a circular motion near one end of said at least one upper housing, ii) a linear motion near an opposite end of said at least one upper housing, and iii) wherein said circular motion and said linear motion move in the same plane;

j) wherein said at least one upper housing and said at least one cradle move with said compound motion; and k) wherein said at least one sleep-assisting apparatus housing comprises at least one hand-carryable element structured and arranged to assist hand-carrying of said at least one sleep-assisting apparatus housing.

2. The system according to claim 1 wherein said at least one upper housing and said at least one lower housing together comprise at least one box geometry comprising at least two half-box sections structured and arranged to be removably coupled into said at least one box geometry.

3. The system according to claim 2 wherein said at least one separator comprises said at least two half-box sections.

4. The system according to claim 1 wherein said at least one motion-generator comprises at least one motor, having at least one motor crankshaft, capable of generating at least rotational motion.

5. The system according to claim 4 wherein said at least one motion-transferer comprises:

a) at least one lever, attachable to said at least one motor crankshaft, structured and arranged to transfer such rotational motion; and b) at least one receiver, attached to said at least one upper housing, structured and arranged to receive such rotational motion from said at least one lever and transfer such rotational motion to such at least one cradle portion.

6. The system according to claim 5 wherein:

a) said at least one lever comprises at least one projecting engager structured and arranged to assist rotational transfer of such rotational motion; and b) said at least one receiver is structured and arranged to receive said at least one projecting engager.

7. The system according to claim 6 wherein said at least one lever comprises exactly one lever having a length from about one inch to about two inches.

8. The system according to claim 7 wherein said at least one projecting engager comprises exactly one projecting engager having a diameter from about one-eighth inch to about two inches.

9. The system according to claim 1 wherein said at least one controller comprises at least one on/off motor-power-supply switch.

10. The system according to claim 4 wherein said at least one motor comprises at least one motor sounder structured and arranged to cause sound vibration sufficient to vibrate said at least one cradle portion.

11. The system according to claim 10 wherein said at least one lower housing is structured and arranged to enhance sound-vibration from said at least one motor sounder.

12. The system according to claim 11 wherein said at least one motor comprises at least one motor vibrator structured and arranged to cause vibration sufficient to vibrate said at least one cradle portion.

13. The system according to claim 1 wherein said at least one sleep-assisting apparatus housing comprises at least one vibrator structured and arranged to cause vibration sufficient to vibrate at least said at least one cradle portion.

14. The system according to claim 5 wherein said at least one upper housing comprises:

a) a first side; and b) a second side;

c) wherein said first side comprises said at least one cradle; and d) wherein said second side comprises said at least one receiver.

15. The system according to claim 14 wherein said at least one lower housing comprises:

a) a third side; and b) a fourth side;

c) wherein said third side comprises said at least one first support to support said at least one upper housing; and d) wherein said fourth side comprises at least one second support to support said lower housing.

16. The system according to claim 1 wherein said at least one sleep-assisting apparatus housing comprises at least one lockable coupler structured and arranged to provide lockable coupling to couple together said at least one lower housing and said at least one upper housing.

17. The system according to claim 16 wherein said at least one hand-carryable element comprises at least one handle structured and arranged to assist hand-carrying by at least one person.

18. The system according to claim 16 wherein said at least one cradle is structured and arranged to cradle a baby.

19. A system, relating to providing a portable sleep-assisting environment to assist sleep of at least one infant in at least one infant carrier, comprising:

a) sleep-assisting apparatus housing means for housing at least one sleep-assisting apparatus;

b) wherein said sleep-assisting apparatus housing means comprises i) lower housing means for housing lower elements, and ii) upper housing means for housing upper elements, iii) wherein said upper housing means comprises cradle means for cradling at least the at least one infant carrier, and iv) wherein said lower housing means comprises support means for supporting said upper housing means;

c) wherein said sleep-assisting apparatus housing means further comprises separator means for separating movement between said lower housing means and said upper housing means;

d) wherein said sleep-assisting apparatus housing means comprises motion-generator means for generating motion to said cradle means;

e) wherein said motion-generator means comprises controller means for assisting user-control of at least one on/off motion control;

f) wherein said motion-generator means comprises motion-transferer means for transferring motion to said cradle means;

g) wherein said motion-transferer means comprises means for imparting shaft-driven rotary planar to linear planar translational motion to said cradle means when said upper housing means is situate upon said lower housing means;

h) wherein said shaft driven rotary planar to linear planar translational motion comprises a compound motion disposed above said lower housing means;

i) wherein said compound motion comprises i) a circular motion near one end of said upper housing means, ii) a linear motion near an opposite end of said upper housing means, and iii) wherein said circular motion and said linear motion move in the same plane;

j) wherein said upper housing means and said cradle means move with said compound motion; and k) wherein said sleep-assisting apparatus housing means comprises hand-carryable element means for assist hand-carrying of said sleep-assisting apparatus housing means.

20. The system according to claim 19 wherein said sleep-assisting apparatus housing means comprises lock means for locking said upper housing means and said lower housing means together.

* * * * *